US008608585B2

(12) United States Patent
Stites et al.

(10) Patent No.: US 8,608,585 B2
(45) Date of Patent: Dec. 17, 2013

(54) GOLF CLUB HEAD OR OTHER BALL STRIKING DEVICE HAVING A REINFORCED OR LOCALIZED STIFFENED FACE PORTION

(75) Inventors: John T. Stites, Weatherford, TX (US); Andrew G. V. Oldknow, Beaverton, OR (US); Adam Liber, Portland, OR (US)

(73) Assignee: Nike, Inc., Beaverton, OR (US)

( * ) Notice: Subject to any disclaimer, the term of this patent is extended or adjusted under 35 U.S.C. 154(b) by 225 days.

(21) Appl. No.: 12/430,485

(22) Filed: Apr. 27, 2009

(65) Prior Publication Data

US 2010/0273565 A1 Oct. 28, 2010

(51) Int. Cl.
*A63B 53/06* (2006.01)

(52) U.S. Cl.
USPC ..... 473/282; 473/346

(58) Field of Classification Search
USPC ..... 473/282, 345
See application file for complete search history.

(56) References Cited

U.S. PATENT DOCUMENTS

| | | | | |
|---|---|---|---|---|
| 4,438,931 | A | | 3/1984 | Motomiya |
| 4,681,321 | A | | 7/1987 | Chen et al. |
| 4,732,389 | A | | 3/1988 | Kobayashi |
| 5,067,715 | A | | 11/1991 | Schmidt et al. |
| 5,080,366 | A | | 1/1992 | Okumoto et al. |
| 5,295,689 | A | | 3/1994 | Lundberg |
| 5,380,010 | A | | 1/1995 | Werner et al. |
| 5,451,058 | A | | 9/1995 | Price et al. |
| 5,464,211 | A | * | 11/1995 | Atkins, Sr. ..... 473/377 |
| 5,547,427 | A | | 8/1996 | Rigal et al. |
| 5,570,886 | A | | 11/1996 | Rigal et al. |
| 5,586,948 | A | | 12/1996 | Mick |
| 5,839,975 | A | | 11/1998 | Lundberg |
| 5,873,791 | A | | 2/1999 | Allen |
| 5,941,782 | A | | 8/1999 | Cook |
| 5,997,415 | A | | 12/1999 | Wood |
| 6,193,614 | B1 | | 2/2001 | Sasamoto et al. |

(Continued)

FOREIGN PATENT DOCUMENTS

| | | |
|---|---|---|
| JP | 9-285578 | 4/1996 |
| JP | 9-173510 | 7/1997 |

(Continued)

OTHER PUBLICATIONS

International Search Report and Written from PCT application No. PCT/US2010/031542 mailed Aug. 3, 2010.

(Continued)

*Primary Examiner* — Michael Dennis
(74) *Attorney, Agent, or Firm* — Banner & Witcoff, Ltd.

(57) ABSTRACT

A ball striking device, such as a golf club head, has a head that includes a face configured for striking a ball and a body connected to the face. A brace extends from an inner surface of the body or from a perimeter weight system to a contact point on the rear surface of the face. This brace may extend from the sole or a sole oriented perimeter weight member to the rear surface of the face. The brace applies force to the face (at least when the face is flexed by a threshold amount) such that the area of the face surrounding the contact point has less flexibility relative to other areas of the face located away from the contact point. The brace and club head may include structures that allow one to control and customize the force applied to the face.

30 Claims, 12 Drawing Sheets

(56) References Cited

U.S. PATENT DOCUMENTS

| | | | | |
|---|---|---|---|---|
| 6,299,547 | B1 * | 10/2001 | Kosmatka | 473/329 |
| 6,332,848 | B1 | 12/2001 | Long et al. | |
| 6,402,637 | B1 | 6/2002 | Sasamoto et al. | |
| 6,435,982 | B1 | 8/2002 | Galloway et al. | |
| 6,475,101 | B2 * | 11/2002 | Burrows | 473/334 |
| 6,558,271 | B1 | 5/2003 | Beach et al. | |
| 6,605,007 | B1 | 8/2003 | Bissonnette et al. | |
| 6,641,490 | B2 | 11/2003 | Ellemor | |
| 6,800,038 | B2 | 10/2004 | Willett et al. | |
| 6,960,142 | B2 | 11/2005 | Bissonnette et al. | |
| 6,994,635 | B2 | 2/2006 | Poynor | |
| 7,018,303 | B2 | 3/2006 | Yamamoto | |
| 7,041,003 | B2 | 5/2006 | Bissonnette et al. | |
| 7,056,229 | B2 | 6/2006 | Chen | |
| 7,140,975 | B2 | 11/2006 | Bissonnette et al. | |
| 7,140,977 | B2 * | 11/2006 | Atkins, Sr. | 473/346 |
| 7,192,364 | B2 | 3/2007 | Long | |
| 7,207,898 | B2 | 4/2007 | Rice et al. | |
| 7,247,104 | B2 | 7/2007 | Poynor | |
| 7,258,631 | B2 | 8/2007 | Galloway et al. | |
| 7,261,643 | B2 | 8/2007 | Rice et al. | |
| 2003/0190975 | A1 * | 10/2003 | Fagot | 473/346 |
| 2004/0219991 | A1 | 11/2004 | Suprock et al. | |
| 2005/0032586 | A1 | 2/2005 | Willett et al. | |
| 2006/0019770 | A1 | 1/2006 | Meyer et al. | |
| 2006/0046868 | A1 | 3/2006 | Murphy | |
| 2006/0068932 | A1 | 3/2006 | Rice et al. | |
| 2006/0073908 | A1 | 4/2006 | Tavares et al. | |
| 2006/0094531 | A1 | 5/2006 | Bissonnette et al. | |
| 2006/0111201 | A1 | 5/2006 | Nishio et al. | |
| 2007/0155538 | A1 | 7/2007 | Rice et al. | |
| 2007/0173347 | A1 * | 7/2007 | Willett et al. | 473/338 |
| 2008/0015047 | A1 | 1/2008 | Rice et al. | |
| 2008/0032817 | A1 | 2/2008 | Lo | |
| 2008/0064523 | A1 | 3/2008 | Chen | |
| 2010/0029402 | A1 | 2/2010 | Noble et al. | |

FOREIGN PATENT DOCUMENTS

| | | |
|---|---|---|
| JP | 2001-299970 | 10/2001 |
| JP | 2004-174100 | 6/2004 |
| JP | 2004-358225 | 12/2004 |
| JP | 2004033536 | 2/2005 |
| JP | 2007-007063 | 1/2007 |
| JP | 2007029588 | 2/2007 |

OTHER PUBLICATIONS

JP Notice of Reasons for Rejection dated Jul. 1, 2013, from JP Application No. 2012-508528.

* cited by examiner

GOLF CLUB HEAD OR OTHER BALL STRIKING DEVICE HAVING A REINFORCED OR LOCALIZED STIFFENED FACE PORTION

TECHNICAL FIELD

The invention relates generally to ball striking devices, such as golf clubs and golf club heads, having a reinforced or localized stiffened portion on its ball striking face. Certain aspects of this invention relate to golf clubs and golf club heads having a stiffening member extending from the sole area of the club to a rear surface of the ball striking face.

BACKGROUND OF THE INVENTION

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user make the ball fly straighter and truer, in the desired direction, and with improved and/or reliable distance, would be welcome in the art.

Many off-center golf hits are caused by common errors in swinging the golf club which are committed repeatedly by the golfer, and which may be similarly committed by many other golfers. As a result, patterns often can be detected, where a large percentage of off-center hits occur in certain areas of the club face. For example, one such pattern that has been detected is that many golfers tend to hit the ball on the low-heel area of the club face and the high-toe area of the club face (particularly for drivers). Other golfers may tend to miss the center of the golf club face at other areas of the face. Because golf clubs typically are designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called coefficient of restitution ("COR"). The maximum COR for golf club heads is currently limited by the United States Golf Association ("USGA") at 0.83. Accordingly, a need exists to customize or adjust the local flexibility of a golf club face to provide maximized COR in the areas of the face where off-center hits tend to occur most, without exceeding current COR limitations.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts and aspects of the invention in a general form as a prelude to the more detailed description provided below.

Aspects of the invention relate to ball striking devices, such as golf clubs and golf club heads, with a head that includes a face configured for striking a ball and a body connected to the face. A brace extends from a surface of the body to a contact point on the rear surface of the face. In some example structures according to this invention, the brace extends from the sole area of the club body to the rear surface of the face. The brace applies force to the face (at least when the face is exposed to a threshold amount of face flexure) such that the area of the face surrounding the contact point has less flexibility relative to other areas of the face located away from the contact point. The body and the face may define a cavity within the head (e.g., a hollow, wood-type golf club head, such as a driver), and in this configuration, the brace may extend through a portion of the cavity between the sole and the face. In other examples, the body and face may constitute a perimeter weighted, cavity back iron-type golf club head, and the brace may extend from the sole portion of the perimeter weight to the rear surface of the face.

According to one aspect, the brace includes a fixed rod extending from the sole to the face. In some embodiments, an end portion of the brace has an elongated shape in cross-section, creating an elongated contact point on the face. The elongated contact point may extend diagonally across a portion of the face, such as from the high-heel area of the face toward the low-toe area of the face. The contact area may extend in other directions as well, and the contact area may have a wide variety of different sizes and/or shapes without departing from this invention. Additionally, the end portion may be formed by a base attached to the inner surface of the face, with an opening or other structure for receiving the end of the rod therein.

According to another aspect of this invention, the brace may include an adjustable member operable to allow adjustment of the force applied to the face by the brace. For example, the adjustable member may be a screw positioned within a threaded passage, such that turning the screw is operable to adjust the force applied by the brace. A threaded tube extending from the inner surface of the sole toward the face may provide the threaded passage and serve to mount the screw for adjustment. In such structures, the screw may have an engagement portion that is accessible from a bottom surface of the sole for turning the screw.

According to further aspects of the invention, the ball striking device may be a golf club or a head therefor. In such a configuration, a shaft may be connected to the head, such as by a hosel connected to or integrally formed as part of the head.

Other features and advantages of the invention will be apparent from the following specification taken in conjunction with the attached drawings.

BRIEF DESCRIPTION OF THE DRAWINGS

To allow for a more full understanding of the present invention, it will now be described by way of various examples, with reference to the accompanying drawings in which.

Figure 1:
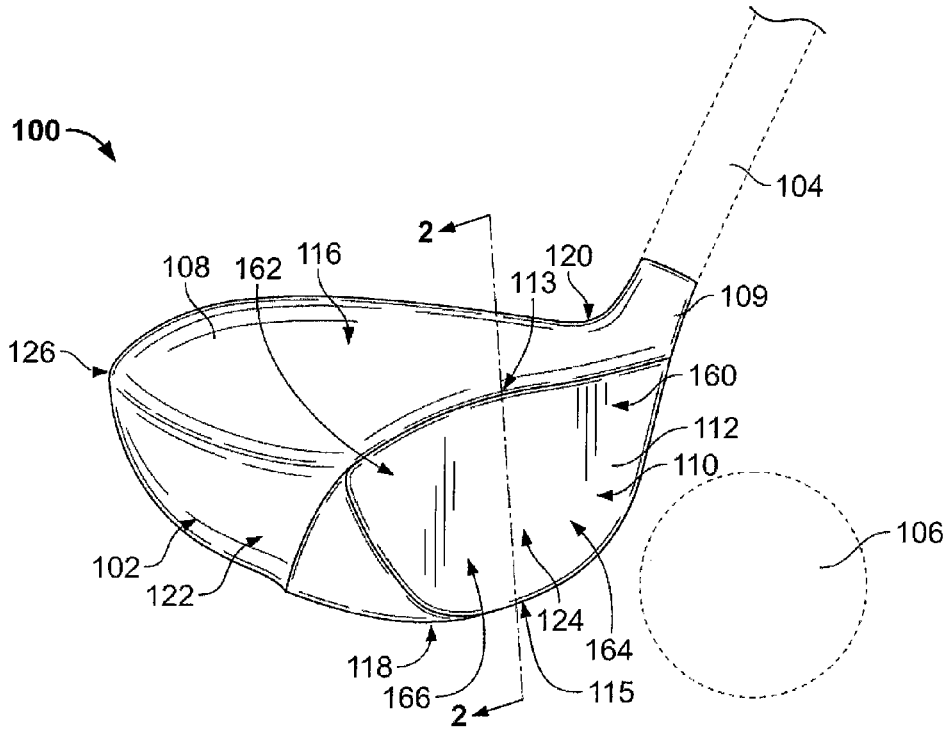
FIG. 1 is a perspective view of one embodiment of a head of a ball striking device according to the present invention, shown with a ball.

The reader is advised that the drawings included herewith are not necessarily drawn to scale, and in some instances, various lines, structures, or details may be omitted from the drawings so as not to obscure the various features being described.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention.

A. TERMS

The following terms are used in this specification, and unless otherwise noted or clear from the context, these terms have the meanings provided below.

The terms "shaft" and "handle" are used synonymously and interchangeably in this specification, and they include the portion of a ball striking device (if any) that extends from the club head body and/or that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

B. GENERAL DESCRIPTION OF ASPECTS OF THIS INVENTION

In general, aspects of this invention relate to ball striking devices, such as golf club heads, golf clubs, and the like. Such ball striking devices, according to at least some examples of the invention, may include a ball striking head and a ball striking surface. Some more specific aspects of this invention relate to wood-type golf clubs and golf club heads, including drivers, fairway woods, wood-type hybrid clubs, and the like, as well as iron-type golf clubs and golf club heads, including 0-irons through 10 irons, all types of wedges, iron-type hybrid clubs, and the like.

According to various aspects of this invention, the ball striking device may be formed of one or more of a variety of materials, such as metals (including metal alloys, such as steels, titanium, titanium alloys, aluminum, aluminum alloys, etc.), ceramics, polymers, composites, fiber-reinforced composites, and wood. The ball striking device may be formed in one of a variety of configurations, without departing from the scope of the invention. In some examples, some or all components of the head, including the face and at least a portion of the body of the head, are made of metals or metal alloys. It is understood that the head may contain components made of several different materials. Additionally, the components may be formed by various forming methods. For example, metal components may be formed by forging, molding, casting, machining, and/or other known techniques. In other example structures, composite components, such as carbon fiber-polymer composites, can be included in the club head structure. Such components may be manufactured by a variety of composite processing techniques, such as prepreg processing, powder-based techniques, mold infiltration, and/or other known techniques. In general, aspects of this invention may be practiced with any desired materials, configured in any desired manners, including with conventional materials, configured and manufactured in conventional manners, as are known and used in the golf club art.

1. Wood-Type Golf Club Heads According to Examples of this Invention

More specific example aspects of this invention relate to wood-type golf clubs and golf club heads (e.g., drivers, fairway woods, wood-type hybrid clubs, etc.) that include: (a) a face configured for striking a ball with an outer surface thereof, (b) a body connected to the face, wherein the body includes a crown portion and a sole portion, and wherein the face and the body cooperate to define a cavity or hollow interior within the head; and (c) a brace extending in a direction from a central inner surface of at least one of the crown portion or the sole portion of the body, across a portion of the cavity, to an inner surface of the face. The brace applies force to the face (at least when the face flexes at least a threshold amount during contact with a golf ball) such that an area of the face surrounding a contact point between the brace and the face has less flexibility relative to other areas of the face located away from the contact point.

2. Iron-Type Golf Club Heads According to Examples of this Invention

Additional aspects of this invention relate to iron-type golf club heads that include: (a) a ball striking face; (b) a body engaged or integrally formed with the face, the body having a cavity back structure including a perimeter weight system (e.g., including at least a sole oriented perimeter weight portion and a top line oriented perimeter weight portion); and (c) a brace extending from the perimeter weight system to a contact point on a rear surface of the face. This brace applies force to the face (at least when the face flexes at least a threshold amount during contact with a golf ball) such that an area of the face surrounding the contact point has less flexibility relative to other areas of the face located away from the contact point.

3. Additional Potential Features of Golf Club Heads According to Examples of this Invention In some example structures in accordance with this invention, the brace will be fixedly engaged with respect to the club head body and the face. In other structures, the brace will be fixedly engaged at one end and located in contact with or in close proximity to the surface at the other end. When the brace is located in close proximity to but spaced from the rear surface of the face, the "threshold amount" of flex of the face in response to contact with a golf ball necessary to induce the application of force to the face by the brace may be any inward flexural displacement of the inner surface of the face from its static, unflexed condition at a location on the face corresponding to the contact point. In other examples of the invention, this "threshold amount" may constitute an inward flexural displacement of the inner surface of the face from its static, unflexed condition of at least 0.01 inches at a location of the face corresponding to the contact point, or even at least 0.1 inches, at least 0.25 inches, or even at least 0.5 inches (i.e., the face may flex freely over this spacing or "threshold amount," after which the brace will apply force to the rear surface of the face). The term "close proximity," as used in this context in this specification, means any separation space between the free end of the brace and the inner surface of the face, sole, crown, perimeter weight member, etc., at which it is located, up to 1 inch. Optionally, the brace may be removable from the club head body, and it may be positionable at multiple different locations within a single club head body.

If desired, at least a portion of the brace (e.g., the portion that contacts or is located in close proximity to the face; the portion that contacts or is located in close proximity to the sole, crown, or perimeter weight member; the central rod or cylinder of the brace; etc.) may be made from a material that flexes when the face flexes in response to contact with a golf ball. The brace also may include an end portion that contacts the face having an elongated shape such that the contact point between the end portion and the face is elongated in shape. This contact point may extend diagonally across a portion of the face, e.g., in a direction extending from a high heel area toward a low toe area.

Club head structures in accordance with at least some examples of this invention may include a brace having an adjustable member operable to allow adjustment and customization of the force applied to the face by the brace. This adjustable member may include a threaded member positioned within a threaded passage, wherein rotation of the threaded member is operable to adjust the force applied by the brace. If desired, the threaded member may include an engagement portion that is accessible from an exterior of the club head body, to allow for rotation of the threaded member to adjust the applied force.

As noted above, club faces in accordance with examples of this invention may include portions that are thinner than conventional faces. For example, for wood type golf club heads, at least some portion of the face may be made to be 2 mm thick or less, and in some examples, 1.75 mm thick or less, 1.5 mm thick or less, 1.25 mm thick or less, or even 1 mm thick or less. Moreover, at least 25% of the wood face surface area may be made at this reduced thickness, and in some examples of this invention, at least 50%, at least 60%, or even at least 70% of the face may have the reduced thickness characteristics described above. For iron type golf club heads, at least some portion of the face may be made to be 2.5 mm thick or less, and in some examples, 2.0 mm thick or less, 1.5 mm thick or less, or even 1.25 mm thick or less. Moreover, at least 25% of the iron face surface area may be made at this reduced thickness, and in some examples of this invention, at least 50%, at least 60%, or even at least 70% of the face may have the reduced thickness characteristics described above. The areas of reduced thickness need not be continuous and need not be of constant thickness.

Also, for golf club structures according to this invention, the size of the area of reduced thickness and/or its thickness may depend, at least in part, on the size of the area of the brace adjacent the rear surface of the face. For large areas of reduced thickness and/or very thin faces, a somewhat larger brace area may be necessary. For smaller areas of reduced thickness and/or less thickness reduction, smaller brace areas may be sufficient. In some more specific examples, the area of the brace located adjacent the face may have a size of at least 5% of the rear surface area of the face. Also, in some examples, this area of the brace also may fall within the range of 10-90% of the rear surface area of the face, 20-80%, 30-70%, or even within 40-60% of the rear area of the face. For large areas of reduced thickness (e.g., at least 40% of the face surface area) and/or very thin faces (e.g., less than 1.25 mm thick for woods and less than 1.5 mm thick for irons), the area of the brace located adjacent the face may have a size of at least 25-90% of the rear surface area of the face, and in some examples, in the range of 30-80% or even 35-70%. For smaller areas of reduced thickness (e.g., 5-35% of the face surface area) and/or less thickness reduction (e.g., 1.25-2 mm thick for woods and 1.5-2.5 mm thick for irons), the area of the brace located adjacent the face may have a size of at least 5-40% of the rear surface area of the face, and in some examples, in the range of 5-35% or even 5-30%.

Additional aspects of this invention relate to methods of producing golf club heads having braces of the types described above (and described in more detail below) and methods of controlling and customizing the flexibility of a golf club face using braces of the types described above (and described in more detail below). Still additional aspects of this invention include golf clubs and methods of making golf clubs, including heads of the types described above.

Given this general description of various aspects of this invention, a more detailed description of specific example structures in accordance with this invention will be provided below.

C. DETAILED DESCRIPTION OF EXAMPLES OF THIS INVENTION

The various figures in this application illustrate examples of ball striking devices according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type and iron-type golf clubs. Such devices may include a one-piece construction or a multiple-piece construction. An example structure of a "wood-type" ball striking device according to this invention will be described in detail below in conjunction with FIGS. 1 through 3, and it will be referred to generally using reference numeral "100." As is known in the art, "wood-type" golf club heads may be made from any desired materials, including any of the various materials noted above.

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. A ball 106 in use is also schematically shown in FIG. 1, in a position to be struck by the ball striking device 100.

Figure 2:
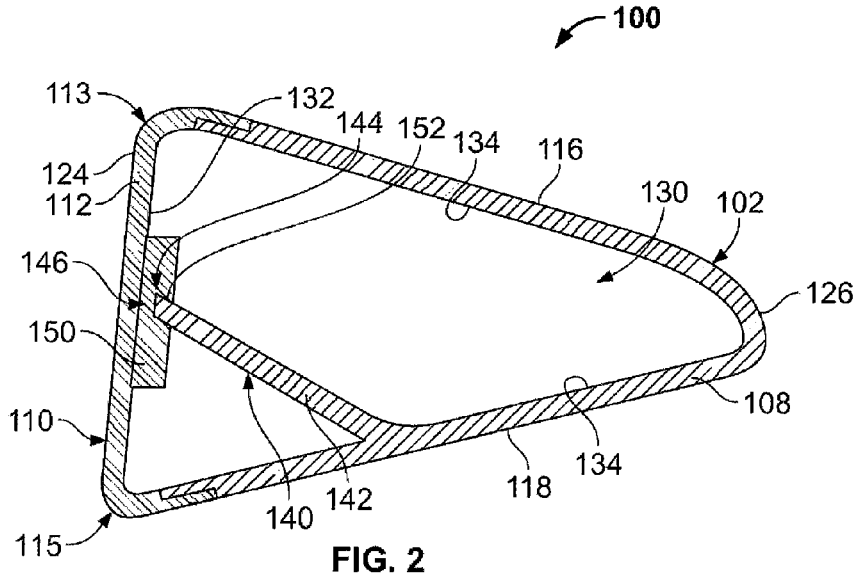
FIG. 2 is a cross-sectional view of a head of the ball striking device of FIG. 1, taken along line 2-2.
Figure 3:
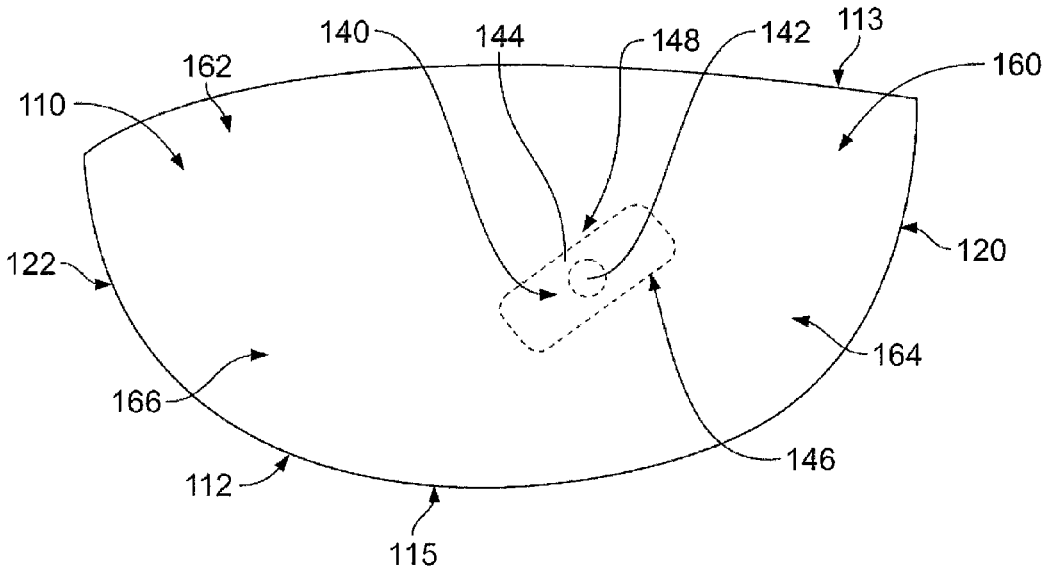
FIG. 3 is a front view of a face of the ball striking device of FIG. 1.

Features of the ball striking head 102 of the ball striking device 100 of FIG. 1 are shown in further detail in FIGS. 2 and 3. In the example structure shown in FIGS. 1 through 3, the ball striking head 102 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIGS. 1 through 3, the head 102 has a relatively large volume, as the club 100 is designed for use as a driver or other wood-type club, intended to hit the ball accurately over long distances. In other applications, such as for different types of golf clubs, the head may be designed to have different dimensions and configurations. When configured as a driver, the club head may have a volume of at least 400 cc, and in some structures, at least 450 cc, or even at least 460 cc. Other appropriate sizes and constructions for other club heads may be readily determined by those skilled in the art.

In the example structure 100 illustrated in FIGS. 1 through 3, the head 102 has a hollow structure defining an inner cavity 130 (e.g., defined by the face 112 and the body 108). Thus, the head 102 has a plurality of inner surfaces defined therein. The inner surfaces include an inner face surface 132 (i.e., the rear side of the ball striking face 112) and a plurality of inner body surfaces 134. As illustrated in FIG. 2, the hollow center cavity 130 may be filled with air (or another gas). However, in other example structures, the head 102 could be filled or partially filled with another material, such as a foam. In still further examples, the solid materials of the head may occupy a greater proportion of the volume, and the head may have a smaller interior cavity or no inner cavity or open space at all. It is understood that the inner cavity 130 may not be completely enclosed in some embodiments.

The face 112 is located at the front 124 of the head 102, and has a ball striking surface 110 located thereon. The ball striking surface 110 is configured to face a ball 106 in use, and it is adapted to strike the ball 106 when the device 100 is set in motion, such as by swinging. As shown, the ball striking surface 110 may be relatively flat, occupying most of the face 112. For reference purposes, the portion of the face 112 near the top face edge 113 and the heel 120 of the head 102 is referred to herein as the "high-heel area" 160; the portion of the face 112 near the top face edge 113 and toe 122 of the head 102 is referred to herein as the "high-toe area" 162; the portion of the face 112 near the bottom face edge 115 and heel 120 of the head 102 is referred to herein as the "low-heel area" 164; and the portion of the face 112 near the bottom face edge 115 and toe 122 of the head 102 is referred to herein as the "low-toe area" 166. The face 112 may include some curvature in the top to bottom and/or heel to toe directions (e.g., bulge and roll radii), as is known and is conventional in the art. In other embodiments, the surface 110 may occupy a different proportion of the face 112, or the body 108 may have multiple ball striking surfaces 110 thereon. In the embodiment shown, the ball striking surface 110 is inclined slightly with respect to the general plane of the sole 118 (i.e., to provide a loft angle), to give the ball 106 slight lift and spin when struck. In other embodiments, the ball striking surface 110 may have different inclines or loft angles, grooves, and/or other structures, e.g., to affect the trajectory or spin of the ball 106 when propelled. Additionally, the face 112 may have a variable thickness and/or may have one or more internal or external inserts in some embodiments.

The face 112, the body 108, and/or the hosel 109 may be formed as a single piece or as separate pieces that are joined together. In some example structures, the face 112 is formed as a cup-face structure, and the body 108 is formed as one or more separate pieces that is/are joined to the cup-face by an integral joining technique, such as welding, cementing, or adhesively joining. Other known techniques for joining these parts can be used as well, including many mechanical joining techniques. If desired, the hosel 109 may be integrally formed as part of the cup-face, as part of the body 108, or partially from each of these components.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as carbon/graphite fiber-polymer composite materials. In any event, it is contemplated that the shaft 104 may be constructed of different materials without departing from the scope of the invention, including conventional materials that are known and used in the art.

As illustrated in the embodiment of the ball striking device 100 shown in FIGS. 1 through 3, the head 102 has a stiffening member for stiffening a portion of the face 112 in the form of a brace 140 engaged with the inner surface 132 of the face 112. In this example structure 100, the brace 140 extends from an inner surface 134 of the body 108, across at least a portion of the cavity 130, to the inner surface 132 of the face 112. In the example structure 100 shown in FIG. 2, the brace 140 extends from the sole 118 of the body 108 to the inner surface 132 of the face. In other structures, the brace 140 may extend from a different one of the inner surfaces 134 of the body 108, for example, from the top 116 to the face 112. The head 102 need not have an inner cavity, or the inner cavity 130 may be filled with another material, and the brace 140 may extend across or through a solid material or a filler material between the inner body surface 134 and the face 112.

The brace 140 may extend to and contact the sole 118 or top 116 of the golf club head 102 at any desired position without departing from this invention, provided the brace 140 is positioned and oriented (or angled) to provide the desired bracing or supporting functions. As some more specific examples, the brace 140 may intersect with or contact the sole 118 or top 116 at a location rearward from the ball striking face 112 within a range of 25% to 95% of its overall depth D in the front to rear direction (Zone A in FIG. 4D), and in some examples, within 25% to 75% of the overall depth (Zone B in FIG. 4D), or even within 30% to 65% of the overall depth (Zone C in FIG. 4D). Unless otherwise noted or clear from the context, the term "central inner portion" as used herein refers to the portion of the sole 118 or top 116 falling within Zone B. For driver structures, the brace 140 may intersect with or contact the sole 118 or top 116 at a location between 1.25 and 4.75 inches from the bottom face edge 115 or the top face edge 113, respectively, and in some examples, within 1.25 to 3.75 inches from the bottom face edge 115 or the top face edge 113, respectively, or even within 1.5 to 3.25 inches from these edges 115 or 113.

In the structure 100 shown in FIGS. 2 and 3, the brace 140 includes a fixed rod 142 that extends from a central area of the sole 118 to the face 112. The brace 140 also has an end portion 144 connected to the inner face surface 132 to form a contact point 146 between the brace 140 and the face 112. In this configuration, the brace 140 stiffens a portion of the face 112 surrounding the contact point 146. In other words, the brace 140 applies a force to the face 112 (at least when a ball 106 is contacted by the face 112) such that an area 148 of the face 112 surrounding the contact point 146 has less flexibility relative to other areas of the face 112 located away from the contact point 146. Additionally, areas of the face 112 between the stiffened portion 148 and the edge of the face 112 generally have greater flexibility than the stiffened portion 148. These more flexible areas can have a greater trampoline-like effect when a ball is struck there, transferring a greater amount of energy and/or velocity to the ball. The size and shape of the end portion 144 and the contact point 146, as well as the force applied by the brace 140, influence the sizes and shapes of both the stiffened area 148 of the face 112 and the more flexible area(s) of the face 112. Generally, a greater force applied to the face 112 by the brace 140 creates a larger stiffened area 148 and greater stiffness in the area 148. As a result, the size, location, and shape of the contact point 146 can be designed to create stiffened portions 148 and flexible portions having desired sizes, shapes, and locations on the face 112.

In the structure 100 shown in FIG. 2, the end portion 144 is enlarged with respect to the rod 142, and has an elongated shape in cross-section, creating an elongated contact point 146 between the brace 140 and the face 112. If desired, the end portion 144 may include one or more openings therethrough, e.g., to reduce its weight. As shown in FIG. 3, the end portion 144 and the contact point 146 may extend diagonally across a portion of the face 112, e.g., in a direction from the high-heel area 160 of the face 112 toward the low-toe 166 area of the face 112. Stated another way, the elongated contact point 146 extends from a point located toward the top 113 of the face 112 proximate the hosel 109 and toward a point located toward the bottom 115 of the face 112 and further away from the hosel 109. In this configuration, the high-toe 162 areas (and perhaps the low-heel area 164) of the face 112 have greater flexibility relative to other areas of the face 112, and at least the high-heel 160 area of the face 112 has relatively less flexibility. In other embodiments, the end portion 144 and contact point 146 may be differently shaped and/or differently oriented, and these elements may be designed to create different areas of stiffness and flexibility on the face 112. For example, if desired, the end portion 144 may be Y-shaped, curved, polygon-shaped, annular, etc. As still additional examples, multiple end portions 144 may be provided, and the brace 140 may include one or more end portions that engage the multiple end portions 144. Other brace 140 and/or end portion 144 combinations and/or arrangements are possible without departing from this invention.

The end portion 144 and/or contact point 146 may have any desired sizes without departing from the invention, e.g., to produce the localized stiffness features described above. As some more specific examples, the end portion 144 and/or the contact point 146 may cover an area of the inner surface 132 of the face 112 of at least 0.1 square inches, or even within the range of 0.1 square inches to 3 square inches. In other examples, this area of the end portion 144 or the contact point 146 may be in the range of 0.25 square inches to 2.5 square inches, or even in the range of 0.5 square inches to 1.75 square inches. The end portion 144 and/or contact point also may be positioned at any desired location on the face without departing from this invention, as will be described in more detail below. Similarly, the brace 140 may be sized and positioned with respect to the face 112 and the body 102 such that it extends rearward from the face 112 and makes any desired angle with respect to the face 112.

Additionally, in the example structure 100 shown in FIGS. 1 through 3, the end portion 144 is formed by a base 150 attached to the inner face surface 132, having an opening or receiver 152 to receive the end of the rod 142 therein. In this embodiment, the base 150 may be formed as a single piece with the face 112, or it may be connected to the face 112 by an integral joining technique or another joining technique. The end of the rod 142 may be glued, welded, or otherwise affixed in the receiver 152. However, in other embodiments, the end portion 144 may be an integrally-formed structure with the rod 142, or may be a separate piece connected to the rod 142 in another manner. Further, the end portion 144 need not be affixed to the face 112, but it may abut or otherwise contact the inner surface 132 of the face 112.

Figure 4A:
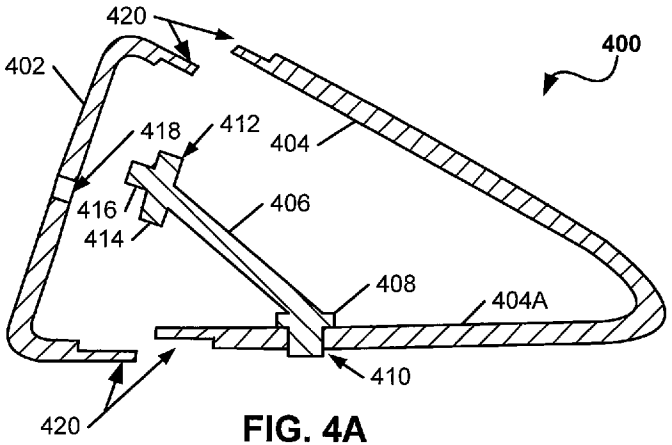
FIGS. 4A through 4D illustrate one example method of making a ball striking device according to this invention.

FIGS. 4A through 4D illustrate one example club head assembly method in accordance with this invention. As shown in FIG. 4A, this example club head 400 begins as three separate and main components (each of which also may be made from multiple parts, if desired). More specifically, as shown in FIG. 4A, the initial parts for making this example club head 400 include a cup face member 402, an aft body member 404, and an internal brace 406. One end of the brace 406 includes a sole engagement portion 408 that extends through an opening 410 defined in the sole portion 404A of the aft body member 404. As shown in FIG. 4A, the sole engagement portion 408 may extend completely through and even stick out of the opening 410, and the sole engagement portion 408 may tightly fit into or somewhat loosely fit into the opening 410.

The brace 406 further includes a face engagement portion 412 at the end thereof opposite the end including the sole engagement portion 408. If desired, as described above in conjunction with FIGS. 1-3, the face engagement portion 412 may include an enlarged contact area 414, e.g., that may be somewhat elongated and oriented in an angular direction (for example, extending in the high-heel to low-toe direction). If desired, this contact area 414 may include some openings or thinned portions, e.g., to reduce its overall weight. The face engagement portion 412 further may include a free end 416 sized and shaped so as to extend into (and optionally all the way through) an opening 418 defined through the face member 402. The free end 416 of the face engagement portion 412 may tightly fit into or somewhat loosely fit into the opening 418.

As the next step in the process, the cup face member 402 may be engaged with the body member 404 by inserting the free end 416 of the face engagement portion 412 into the opening 418 of the cup face member 402 and engaging the cup face member 402 with the club head body 404 at the interface areas 420 (which may extend all the way (or essentially all the way) around the perimeter of the club head 400). Including some "play" or looseness in the brace 406 joint with the cup face 402 and/or with the body member 404 can facilitate easier assembly of the club head during this step. Alternatively, if the brace 406 is somewhat flexible, this feature can facilitate easier assembly of the club head during this step.

The face member 402 may be engaged with the club head body 404 in any desired manner without departing from this invention, including through the use of welding or other fusing techniques, through the use of adhesives or cements, through the use of mechanical connectors, and the like, including through the use of techniques that are conventionally known and used in the art.

Figure 4B:
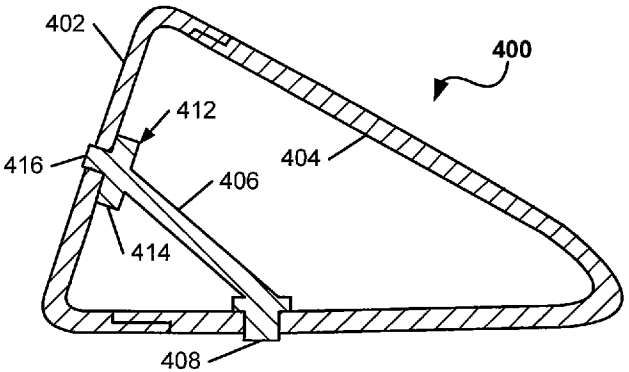
Figure 4C:
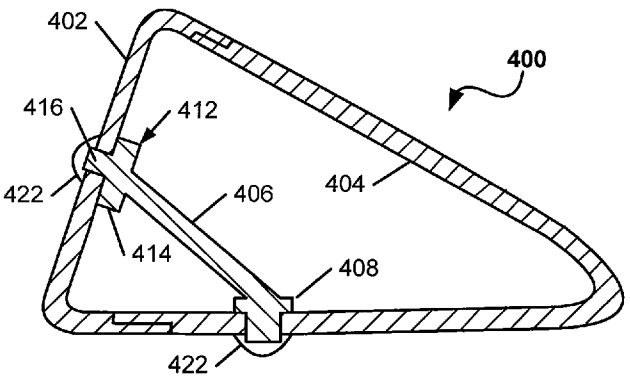
Figure 4D:
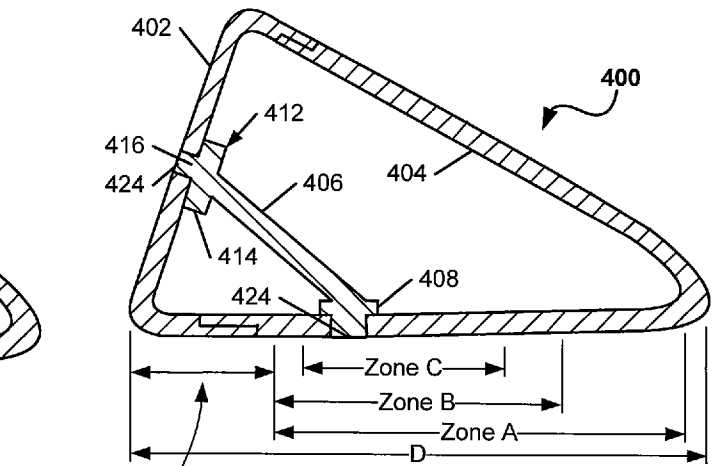

Once provided in the preliminarily constructed phase shown in FIG. 4B, the brace 406 may be permanently fixed in place, e.g., to eliminate any "play" or "looseness" in the joints between the engagement portions 408 and 412 with the body member 404 and the face member 402, respectively. This may be accomplished, as shown in FIG. 4C, for example, by welding the joints (note weld beads 422). The molten material during this welding step may seep into and fill any space within the joints and firmly hold the ends of the brace 406 in place with respect to the body member 404 and the face member 402. Once the weld joints have cooled, the excess external weld bead material 420 may be removed, e.g., by grinding, to produce smooth overall joints 424, as shown in FIG. 4D. Optionally, if desired, the exterior surfaces may be further treated to cover or conceal the appearance of the ends of the brace 406 (e.g., by painting, electroplating, coating, etc.). Alternatively, if desired, the brace 406 may be secured in place by cements or adhesives, mechanical connectors, friction fits, ridged and/or grooved connections, threaded assemblies, etc.

Many variations in this method are possible without departing from the invention. For example, the order of various steps may be changed (e.g., the brace 406 may be welded (or otherwise attached) to the body member 404 before the face member 402 is engaged with the body member 404, etc.). As another potential alternative, the brace 406 may be engaged with the face member 402 before it is engaged with the body member 406. As yet additional examples, variations in the constructions of the various parts are possible without departing from this invention. For example, the face member 402 need not be a cup face. Rather, the face member 402 may be a plate that is welded or otherwise joined to an annular face frame member that is previously engaged with or integrally formed as part of the body member 404. As another example, if desired, the sole portion 404A of the body member 404 (e.g., including the opening 410) may be separate from and attachable to a remainder of the body member 404 after the brace 406 is engaged with the face member 402 and after the face member 402 is engaged with the remainder of the body 404. Other variations also are possible without departing from this invention.

The brace 406 may be made from any desired materials and/or any desired number of separate parts without departing from this invention. For example, the brace 406 (or at least some portions thereof) may be made from a relatively stiff or rigid material, like metals (e.g., titanium, aluminum, steel, or other metal materials (including alloys) conventionally used in golf club construction), polymers, ceramics, etc. The brace 406 also may be sized and constructed such that the majority of its weight is located toward the sole engagement portion 408, to help keep a low overall center of gravity for the club head 400.

Figure 5A:
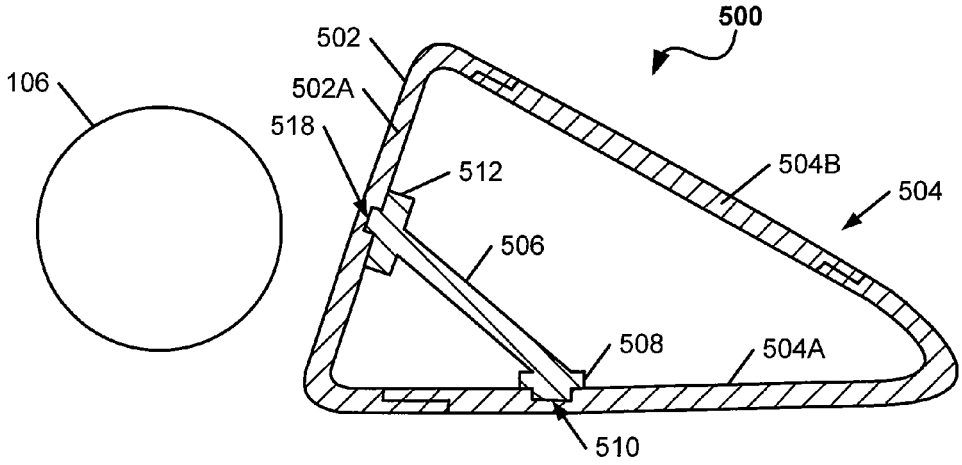
FIGS. 5A and 5B illustrate potential features of example ball striking devices in accordance with at least some examples of this invention.
Figure 5B:
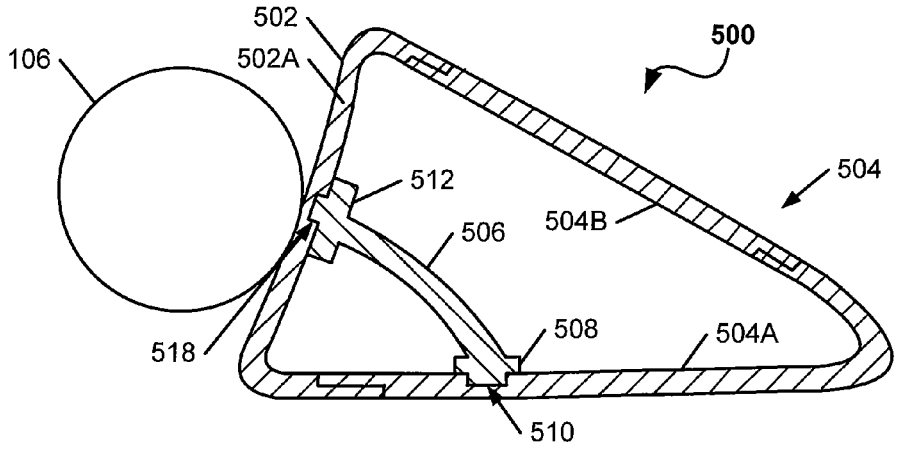

FIGS. 5A and 5B illustrate another example club head structure 500 in accordance with at least some aspects of this invention. While similar to the structure 400 shown in FIGS. 4A through 4D, in this example club head structure 500, the sole engagement portion 508 and the face engagement portion 512 of the brace 506 engage recesses 510 and 518, respectively, formed in the sole portion 504A of the body member 504 and in the rear surface of the face member 502, respectively. The recesses 510 and 518 do not extend all of the way through the sole portion 504A of the body member 504 and through the rear surface of the face member 502, respectively. The engagement portions 508 and 512 may be joined to their respective recesses 510 and 518 in any desired manner without departing from this invention, including through the use of welding, cements, adhesives, mechanical connectors, ridged and grooved constructions, etc., e.g., including in the various ways described above in conjunction with FIGS. 4A through 4D. This structural configuration would avoid the need to weld at the exterior of the body 504 and/or the face 502 and the further need to grind and/or otherwise finish the exterior joint. If desired, the club head body could include a separate crown portion 504B that can be fit in place after the brace 506 is mounted within the club head body. Alternatively, a separate sole portion may be provided that is initially left off the club body to allow access to the club interior while the brace 506 is being mounted to the rear of the face 502 and then attached to the club body (and optionally to the brace 506) after the brace 506 is mounted to the face 502. Other access openings to or ways of gaining access to the club interior to allow for mounting of the brace 506 may be provided without departing from this invention.

As shown in FIGS. 5A and 5B, when the golf club head 500 strikes a ball 106, the club head face component 502A will tend to flex inward somewhat (see FIG. 5B). The rebounding of the face component 502A to its unflexed condition provides a little additional propelling force to the ball (known in the industry as the "trampoline effect"). To limit the "trampoline effect," the Rules of Golf promulgated by the USGA limit the "coefficient of restitution" or "COR" value of golf club faces to be no greater than 0.83. The brace 506, as shown in FIGS. 5A and 5B, can be used to help control and limit the COR and trampoline effect of the golf club face 502A. Additionally, the brace 506 can be provided behind a location in the golf club face where the user tends to not hit the ball on a regular basis so that the remainder of the club face 502A will remain more flexible (and thus provide an improved trampoline effect) at the areas where the user does tend to regularly contact the ball. In this manner, the overall face 502A can remain quite flexible (at least at the local area where the user tends to make contact with the ball) while the brace 506 helps control the overall COR response of the club head and keep it within the USGA limits.

FIGS. 5A and 5B illustrate additional features that may be included in club head structures in accordance with examples of this invention. As shown in these figures, the brace 506 may be flexible such that it bends somewhat when the face component 502A flexes inwardly. By selecting the flexibility characteristics of the brace 506 (e.g., different materials, different dimensions, etc.), the amount of force applied to the rear surface of the face 502A during ball contact (and thus the club head COR and trampoline effect) can be further controlled and adjusted.

Figure 6A:
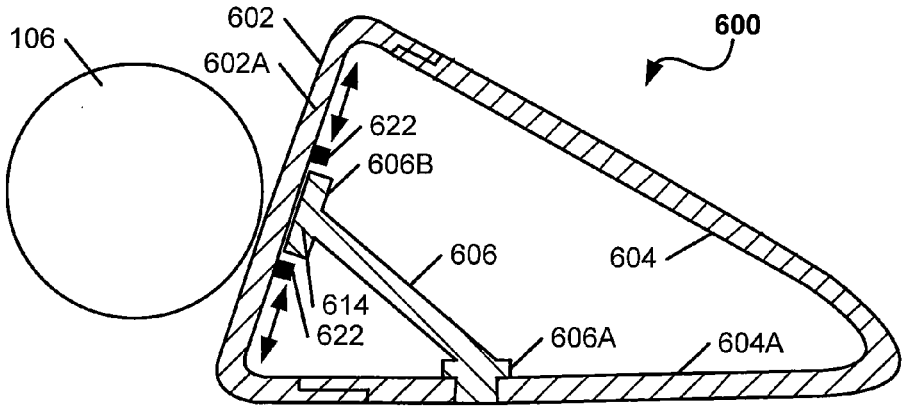
FIGS. 6A and 6B illustrate potential features of additional example ball striking devices in accordance with at least some examples of this invention.
Figure 6B:
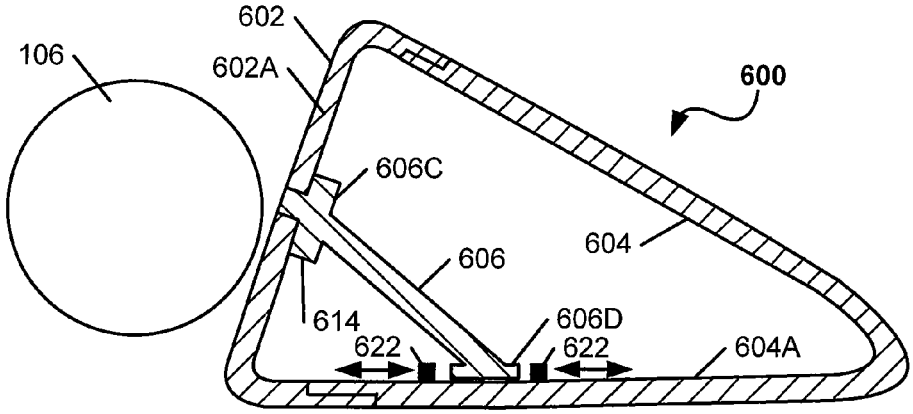

In the club head structures 102, 400, and 500 shown in FIGS. 2, 4A-4D, 5A, and 5B, both ends of the brace members 140, 406, and 506 are fixed with respect to the club head components (e.g., fixedly secured to or integrally formed with the club head face or sole). This is not a requirement. Rather, as shown in FIG. 6A, one end 606A of the brace 606 may be fixed to the interior surface of the sole portion 604A of the body member 604 while the opposite end 606B remains unattached to, but in contact with (or in close proximity to), the rear surface of the face member 602. Alternatively, as shown in FIG. 6B, one end 606C of the brace 606 may be fixed to the rear surface of the face member 602 while the opposite end 606D remains unattached to, but in contact with (or in close proximity to) the interior surface of the sole portion 604A of the body member 604. Optionally, if desired, the contact area of the brace 606 with the rear surface of the face 602 may include an enlarged area 614, optionally oriented at an angle, as described above in conjunction with FIG. 3. If desired, the enlarged area 614 may include openings therethrough, e.g., to reduce its weight. In this manner, when the face 602A flexes in response to contact with a ball 106, the brace 606 may move somewhat with respect to the face 602 and/or the sole portion 604A (e.g., by sliding along the surfaces) while still supporting and applying force against the rear surface of the face component 602A.

If desired, the locations where sliding between the brace 606 and the club head face 602 or body 604 is likely to occur may be formed or treated to include a lubricant material to facilitate smooth and predictable sliding. The ends 606B and 606D may be made from materials that facilitate smooth and easy sliding with respect to the club head body components that they contact such that inclusion of a separate lubricant may be unnecessary. Also, as shown in FIGS. 6A and 6B, the interior surface areas where the sliding may occur may include stopper elements 622 to prevent excessive sliding between the brace 606 and the club head component. These stopper elements 622 may be provided at locations suitable to provide a maximum COR value to the face component 602A and/or to prevent the face component 602A from flexing to such a degree that collapse or other failure is likely. As another example, if desired, the free ends 606B and 606D of the braces 606 in FIGS. 6A and 6B, respectively, could extend into grooves defined in the rear surface of the face and the interior surface of the sole, respectively, and the edges of these grooves could effectively function as the stopper elements 622.

As noted above, in these example structures 600, one end 606B or 606D of the brace 606 is located in contact with or in close proximity to an interior surface of the club head (e.g., the rear surface of the face 602A or the interior surface of the sole portion 604A). When located in close proximity to but spaced from the other surface, the free end 606B and 606D of the brace 606 may be spaced apart from the other surface by any desired distance. For example, assuming that the face 602A is in a static, unflexed condition, then the free ends 606B and 606D may be spaced from their corresponding "close proximity" surface by at least 0.01 inches, and in some examples, by at least 0.1 inches, at least 0.25 inches, or even at least 0.5 inches. The term "close proximity," as used in this context in this specification, means any separation space between the free end 606B or 606D of the brace 606 and its corresponding contact surface, up to 1 inch. If desired, a material may be placed in the space between the free end 606B and 606D and its corresponding contact surface, such as a piece of foam or other polymeric material (e.g., to help prevent or attenuate any audible noise produced when contact is eventually made).

Figure 7:
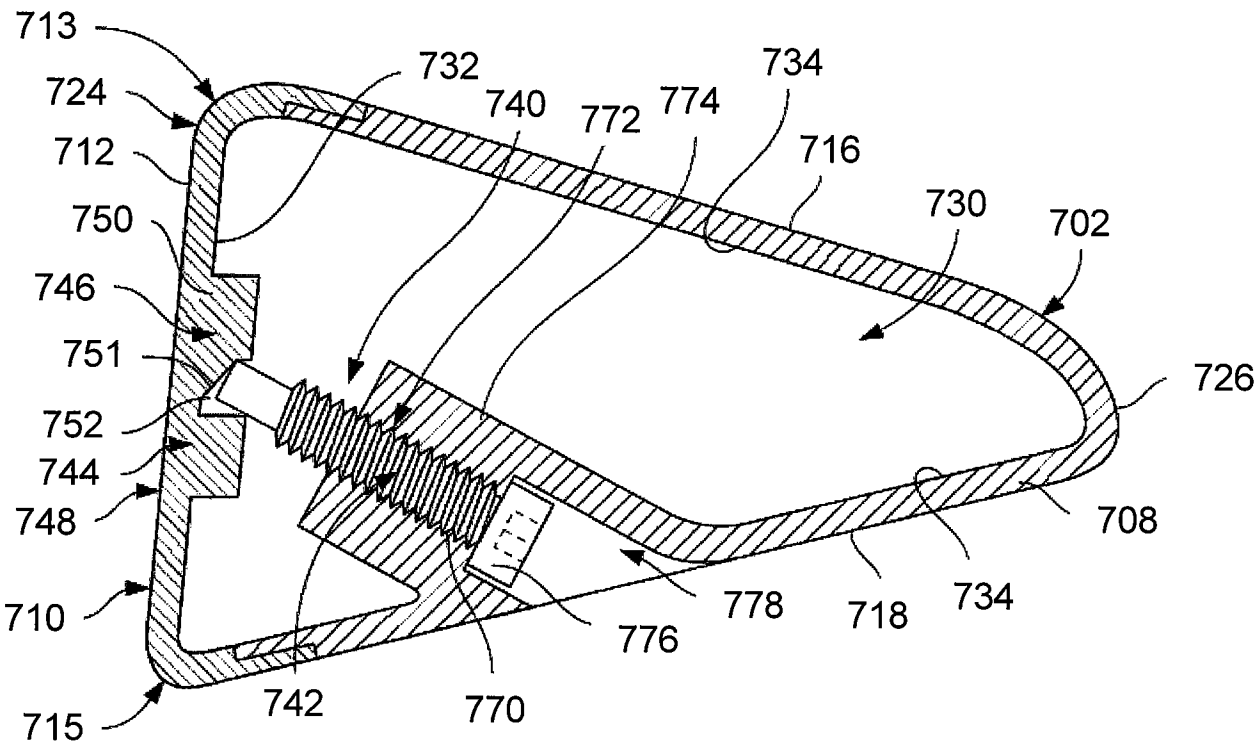
FIG. 7 is a cross-sectional view of another head of a ball striking device in accordance with at least some examples of this invention.

FIG. 7 illustrates another example ball striking device 700 in accordance with this invention, one that is structurally similar to the ball striking device 100 of FIGS. 1 through 3 and contains many of the same or similar components. The common components of the ball-striking device 700, such as the head 702, body 708, and face 712, are referred to similarly in this drawing as referred to above with respect to the ball striking device 100 of FIGS. 1-3, although using the "700" series of reference numerals. The head 702 of the ball striking device 700 of FIG. 7 contains an adjustable brace 740 that is structured differently from the fixed brace 140 described above with respect to FIG. 2.

The adjustable brace 740 includes an adjustable member 742 operable to allow adjustment of the force applied to the face 712 by the brace 740. In the example structure 700 shown in FIG. 7, the adjustable member 742 includes a screw 770 that is received within a threaded passage 772 and exerts a force on the inner surface 732 of the face 712, such that turning the screw 770 is operable to adjust the force applied to the face 712. The adjustable member 742 extends from an inner surface 734 of the body 708 to the inner surface 732 of the face 712 to exert force on the face 712. In this example structure 700, a threaded tube 774 extending at least partially from the sole 718 toward the face 712 defines the threaded passage 772 therethrough. Generally, the adjustable member 742 is accessible through the outer surface of the head 702. More specifically, in the structure 700 illustrated in FIG. 7, the screw 770 has an engagement portion 776, such as a screw head, that is accessible at the sole 718 of the head 702. The engagement portion 776 may be adapted to be engaged by one or more of various tools and devices, such as a hex-head wrench, a torque wrench, an Allen wrench, a Phillips head screwdriver, a standard (flat) screwdriver, or other known tool or device. The sole 718 has a recess 778 proximate the screw head 776 so that the screw head 776 is recessed into the body 708 and does not protrude out of the body 708, potentially affecting a user's swing by catching on the ground or an external object during swinging. Optionally, if desired, the recess 778 may be closed off, e.g., using a cover member or plug that engages the sole or the adjustable member.

The force applied to the face 712 by the brace 740 can be adjusted by tightening or loosening the screw 770. As such, turning the screw 770 to extend the screw 770 further into the head 702 will exert more force on the face 712, and turning the screw to retract from the face 712 will reduce the force exerted on the face 712. Generally, the stiffness and size of the stiffened area 748 on the face 712 increases with increased force applied to the face 712. A scale or other orientation marker may be included on the head 702 and/or the adjustable member 742, so that a user can reliably return the adjustable member 742 to a default or previous orientation. Additionally, such an orientation marker or scale may include multiple indicia, such as approximate COR values for the face 712 or approximate force applied by the brace 740, based on the position of the adjustable member 742 (and thus the force applied by the brace 740 to the face 112).

In the example structure 700 shown in FIG. 7, the end portion 744 of the brace 740 is formed by a base 750 with an opening or receiver 752 that receives the end of the adjustable member 742 therein. The base 750 also may contain an engagement surface 751, on which the adjustable member 742 can exert force. Similarly to the end portion 144 of the brace 140 described above, the end portion 744 may be enlarged and elongated with respect to the screw 770, to create an enlarged and elongated contact point 746 between the brace 740 and the face 712. In one embodiment, the elongated end portion 744 and contact point 746 are shaped similarly to the end portion 144 and contact point 146 of the head 102 of FIG. 3, creating a stiffened area 748 on the face 712 in a similar location to the stiffened area 148 described above and shown in FIG. 3. However, the size and/or relative stiffness of the stiffened area 748 can be adjusted using the adjustable brace, as described above. One skilled in this art, given the benefit of this disclosure, will understand that the size, shape, and location of the end portion 744 can be changed to alter the stiffening properties of the brace 740, as described above with respect to the ball striking device 100 of FIGS. 1 through 3. As also described above, in other embodiments, the end portion 744 may be an integral part of the screw 770, or otherwise may not be fixedly connected to the face 712. Optionally, the end portion 744 may include a flexible or compressible material, such as a foam material, to better enable fine tuning of or finer control over the applied force.

While a screw mechanism is shown for adjusting the force applied to the face 712 in the example of FIG. 7, other adjusting mechanisms may be provided without departing from this invention. For example, a ratchet mechanism, a cam mechanism, or other mechanism may be provided without departing from this invention. Additionally or alternatively, in structures that include more than one force applying brace, all braces may be static (like those shown in FIGS. 2 and 4A-4D), all braces may be adjustable (like that shown in FIG. 7), all braces may include an unattached free end (like those shown in FIGS. 6A and 6B), all braces may be flexible (like that shown in FIGS. 5A and 5B), or a combination of these different types of braces may be provided without departing from this invention.

Figure 8A:
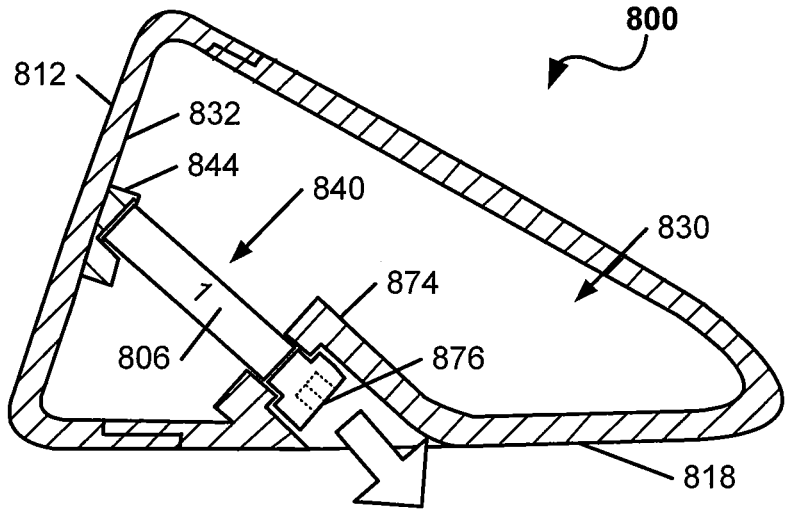
FIGS. 8A through 8D illustrate examples of customization and adjustability features of ball striking devices according to at least some examples of this invention.

FIGS. 8A through 8D illustrate additional example features that may be incorporated into golf club heads in accordance with at least some examples of this invention. The club head 800 shown in this example structure may be similar to that shown in FIG. 7, including a tube 874 allowing access to the interior 830 of the club head 800. In this example structure 800, however, the overall brace 840 includes multiple parts. More specifically, the brace includes a contact portion 844 (engaged with or integrally formed on a rear surface 832 of the face 812), a removable brace portion 806, and a cap member 876 (which, optionally, may apply a force to press and hold brace portion 806 between the tube 874 and the contact portion 844). As shown in FIG. 8A, at least some of the brace portion 806 may remain within the tube 874. The cap member 876 may engage and secure to the tube 874 in any desired manner, such as via a threaded connection, via a cam connection, via another mechanical connection, etc. The brace 840 may support and/or supply force against the rear surface 832 of the face 812, e.g., in the various manners described above.

In some instances, it may be desired to provide a club head 800 with a more flexible face (e.g., to improve the "trampoline effect" for players with slower swing speeds, etc.). On the other hand, in some instances, a less flexible face may be desired (e.g., to prevent failure of faces for players with very high swing speeds, etc.). The club head structure 800 of FIGS. 8A through 8D allows for some COR adjustment and/or customizability.

Figure 8B:
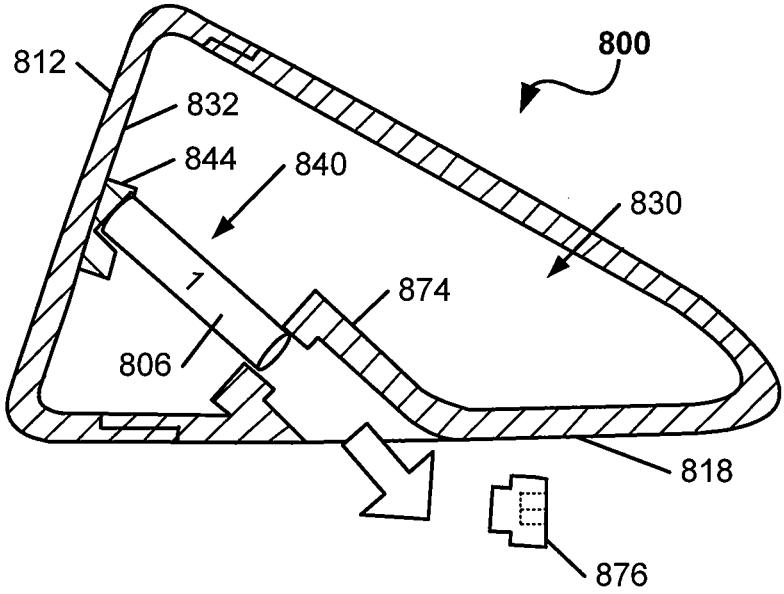

For example, as illustrated in FIG. 8A, the club head 800 is initially configured with brace portion 806 extending between the contact portion 844 and the cap member 876. Should a user or club fitter determine that this specific brace portion 806 is not providing the desired performance, it can be interchanged with a different brace portion having different characteristics. As an initial step in this interchange, as shown in FIGS. 8A and 8B, the cap member 876 is removed from the tube 874 (e.g., by unscrewing it, by otherwise disengaging it, etc.). This allows the user access to the interior chamber 830 of the club head 800 and to the brace portion 806.

Figure 8C:
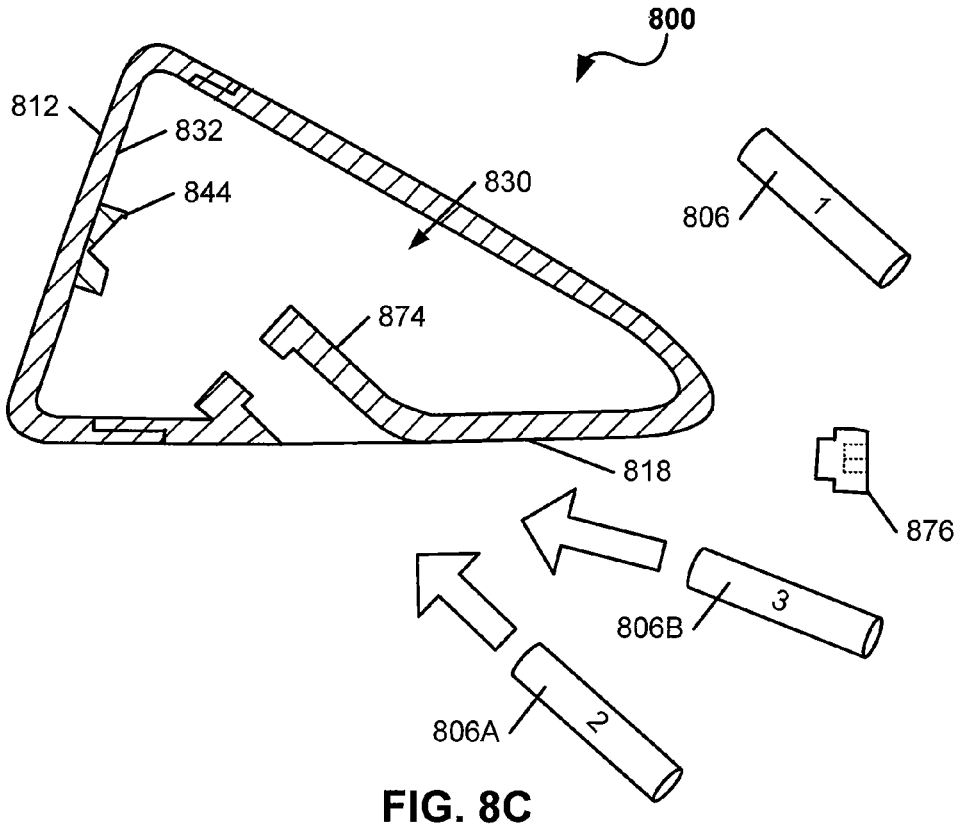
Figure 8D:
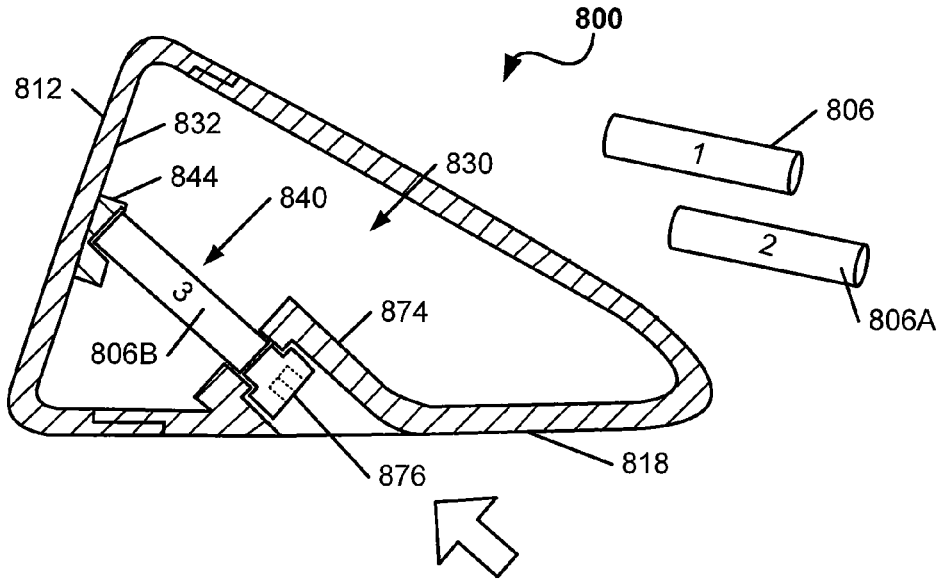

Optionally, if desired, the brace portion 806 may be connected to the cap member 876 such that the brace portion 806 may be removed from the club head 800 at the same time that the cap member 876 is pulled from the tube 874. As another alternative, if desired, the brace portion 806 may be fit into a receptacle provided in the contact portion 844 such that the ends of the brace portion 806 contact and extend between the receptacle provided in the contact portion 844 and the end of the tube 874. The tube 874 may extend any desired portion of the distance between the sole 818 and the contact portion 844, including this entire distance. As yet additional options, if desired, the brace portion 806 may be loosely fit within the area between the tube 874 and the contact portion 844, or it also may be engaged with at least one of these members, e.g., by a threaded connection, by a turnbuckle assembly, by another mechanical connector system, etc. Then, as shown in FIGS. 8B and 8C, the brace portion 806 may be removed from the interior 830 of the club head 800 (optionally, some sort of tool may be required to make this extraction, such as engagement of a pulling mechanism with the exposed end of the brace portion 806).

Once the original brace portion 806 is extracted, a different brace portion (e.g., brace portions 806A or 806B) can replace it, and the cap member 876 may be replaced. See FIGS. 8C and 8D. The various brace portions 806, 806A, and 806B may have different stiffnesses or flex characteristics, different lengths, different materials, different hardnesses, different longitudinal flexibility, etc., and they may include indicia thereon that indicate the relevant characteristics. A club fitter or a club user can test various different brace portions 806, 806A, and 806B and select the one best suited for their use (e.g., one that provides the best results, one that feels most comfortable to the player, one best suited to existing play conditions (for example, to provide a high or low launch, to provide the desired spin characteristics, etc.), one that prevents excessive face deformation due to the swing speed, etc.).

Figure 9:
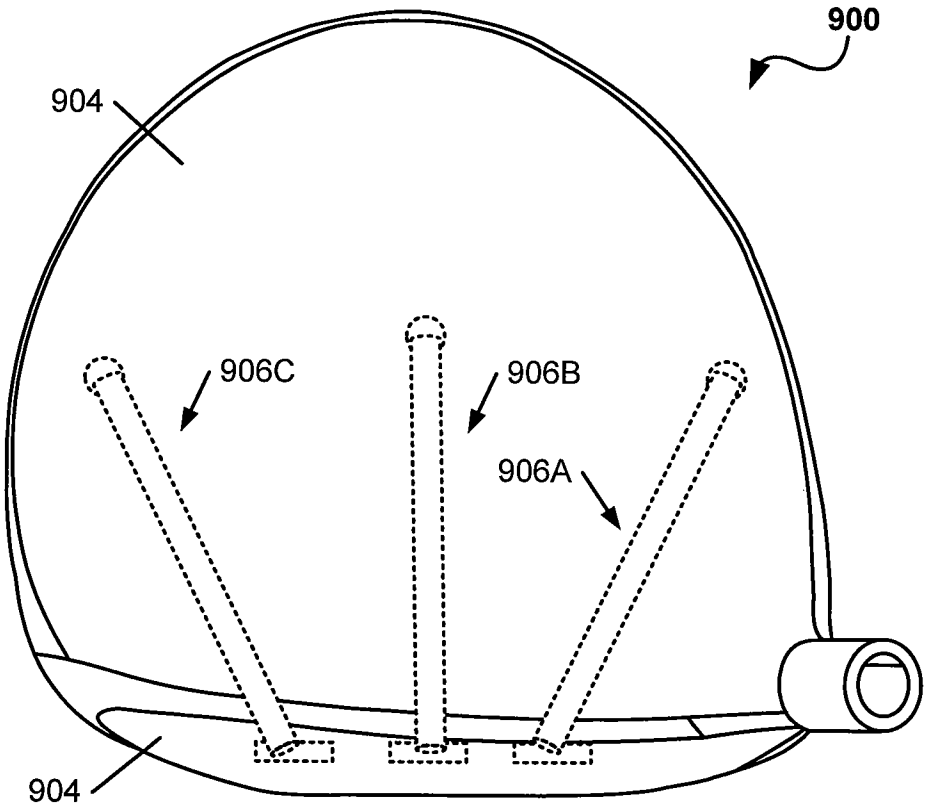
FIG. 9 illustrates an example wood-type golf club head construction according to at least some examples of this invention.

FIG. 9 illustrates additional potential features of golf club heads 900 in accordance with at least some examples of this invention. This figure illustrates that the brace system may be located at multiple different locations and/or different orientations with respect to a club head face 902 and a club head body 904. For example, as shown in FIG. 9, a first brace system 906A may be located in the heel area of the club head structure 900 (to apply force at the heel area of the face 902), a second brace system 906B may be located in the central area of the club head structure 900 (to apply force at the central area of the face 902), and a third brace system 906C may be located in the toe area of the club head structure 900 (to apply force at the toe area of the face 902). If desired, braces inserted through any of the inlet ports may be sized, shaped, and adapted to extend to any of the desired face contact locations (e.g., so that a brace inserted at the toe end contacts the middle or heel location on the face).

An individual club head 900 may have any one or more brace system orientations available, and the user or a club fitter can select which brace system orientation to use for a specific golfer, e.g., based on the contact pattern where the club head face 902 tends to meet the ball. For example, if the user predominantly makes contact at the toe end of the club face 902, use of the heel oriented brace system 906A may be most appropriate (e.g., to keep the toe end more flexible but to maintain an overall COR response within the limitations of the rules). If the user predominantly makes contact at the heel end of the club 902, use of the toe oriented brace system 906C may be most appropriate (e.g., to keep the heel end more flexible but to maintain an overall COR response within the limitations of the rules). If the user has a very high swing speed or if his or her contact does not fall within a discernible, repeatable pattern, then use of the central brace system 906B may be the most appropriate (e.g., to provide a backstop to prevent club damage and/or to maintain the face COR characteristics within the limitations of the rules). Additionally, if desired, face contact locations may be provided to allow for selective placement of the stiffened zones and the flexible zones higher or lower on the club face (i.e., by providing different vertical locations for the contact area(s)). The various brace systems 906A, 906B, and/or 906C may include structure to receive the braces, e.g., in any of the various manners described above, and the various brace systems within a single club head 900 (when multiple brace systems are present) may be the same or different without departing from this invention.

In this example structure 900, the club head 900 includes multiple brace system receptacles. If desired, a single brace system may be mounted in such a club head, and optionally, one or more of the other receptacles may be used to receive weights (e.g., in the form of threaded cap members 876) to help balance the club 900. As another alternative, if desired, more than one of the brace system receptacles could have equipment mounted therein (e.g., in order to maintain a weight balance of the club head 900), but fewer than all of the receptacles may actually apply force to the rear surface of the face 902. As yet another alternative, one (or some) of the mounted brace systems may apply force to the rear surface of the face while one or more of the other brace systems may be arranged only to provide a backstop against extreme face flexure, e.g., as a backstop against damage when an extremely high swing speed is achieved. Thus, when multiple brace system receptacles are provided on a single club head 900, any number of those receptacles may have actual braces (or actually functioning braces) mounted therein.

Figure 10A:
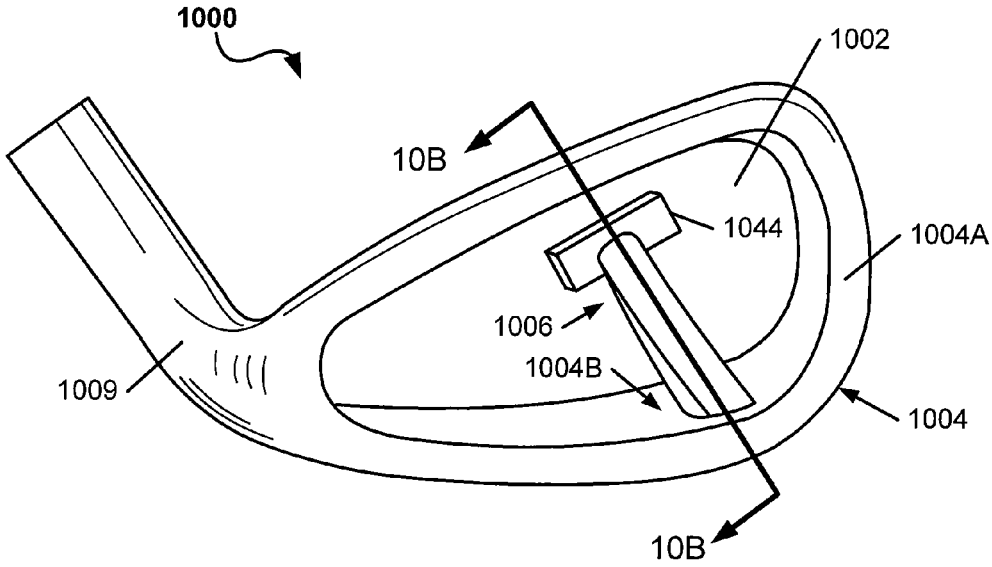
FIGS. 10A through 10D illustrate potential features of example iron-type ball striking devices in accordance with some examples of this invention.

While the invention has been described above in conjunction with wood-type golf clubs and golf club heads (including drivers), aspects of this invention are not limited to such clubs. Rather, the various aspects and features of this invention may be applied for use in iron-type golf clubs and golf club heads. FIG. 10A illustrates an example of an iron-type golf club head 1000 in accordance with some aspects of this invention. As shown, the iron-type golf club head 1000 has a ball striking face 1002 (the rear surface of which is shown in FIG. 10A), a body portion 1004 (including one or more individual parts) including a perimeter weighting system 1004A, and a hosel member 1009 for connecting to a shaft (not shown in FIG. 10A). The perimeter weighting system 1004A and the rear surface of the ball striking face 1002 define a rear cavity back iron structure. A brace system 1006 extends from the rear surface of the ball striking face 1002 to an interior surface 1004B of the sole portion of the perimeter weighting system 1004A. As further shown in FIG. 10A, the brace system 1006 may include an elongated contact area 1044 located at a desired portion of the club head face 1002 to provide face support and/or localized stiffening, as described above. The ends of the brace system 1006 may contact the face 1002 and/or the perimeter weighting system 1004A at any desired locations, and the brace 1006 may extend at any desired angle without departing from this invention. In some example structures according to the invention, the brace 1006 will intersect the perimeter weighting member 1004A as far rearward as possible, e.g., within the rear 50%, or even the rear 25% of the club head structure.

Figure 10B:
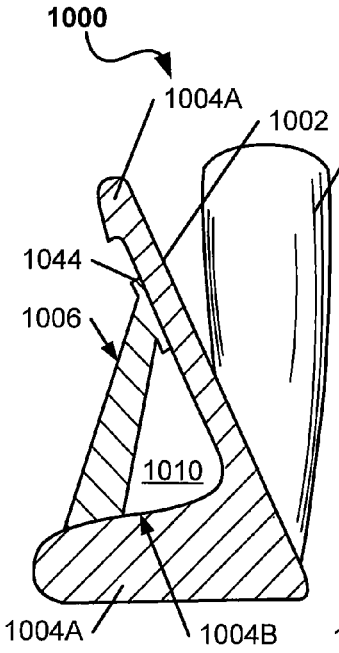

FIG. 10B is a cross sectional view taken along line 10B-10B of FIG. 10A. As shown, in this example structure 1000, both ends of the brace system 1006 are fixed to the club head structure, i.e., one end (including the contact area 1004) fixed to the rear surface of the face 1002 and the opposite end fixed to the interior surface 1004B of the perimeter weighting system 1004A. In this illustrated example structure 1000, the bottom end of the brace system 1006 is provided along the interior surface 1004B of the sole portion of the perimeter weighting system 1004A (although the brace could extend to other portions of the perimeter weighting member 1004A, if desired, such as the top surface, a side surface, etc.). Notably, an open space 1010 is defined between the extending rod of the brace system 1006 and the rear surface of the face 1002 (alternatively, this open space 1010 may be filled, e.g., with a wall element). The brace system 1006 may be fixed in place in any desired manners without departing from this invention, including through the use of welding or other fusing techniques, through the use of adhesives or cements, through the use of mechanical connectors or other mechanical retaining member structures, etc. The club head 1000 and brace system 1006 may have any of the desired constructions, properties, or characteristics described above, e.g., for the club heads and fixed brace systems of FIGS. 2, 4A-4D, and 5A-5B, without departing from this invention.

Figure 10C:
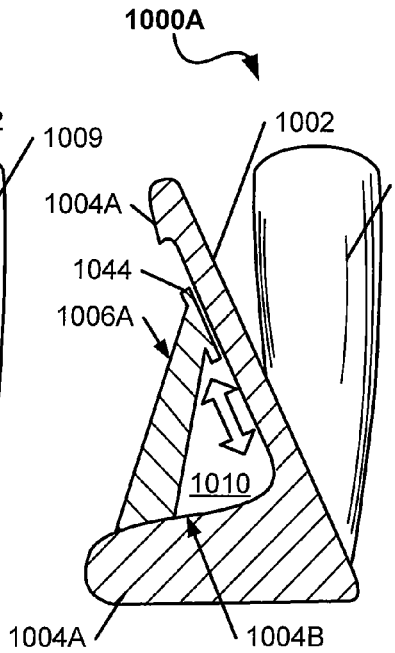

Alternative iron-type club head constructions also are possible without departing from this invention. For example, FIG. 10C shows a club head structure 1000A similar to that of FIGS. 10A and 10B, except in the structure 1000A of FIG. 10C, the top end of the brace system 1006A (including the contact portion 1044) is not fixed to the rear surface of the face 1002. Instead, the top end of the brace system 1006A (including the contact portion 1044) is located in contact with or in close proximity to the rear surface of the face 1002. In this manner, as described above in conjunction with FIG. 6A, the contact portion 1044 may move or slide somewhat with respect to the rear surface of the face 1002 when the face 1002 flexes (e.g., at least a predetermined amount) in response to contact with a golf ball. This example club head structure 1000A and brace system 1006A may have any of the desired constructions, properties, or characteristics described above, e.g., for the club heads and brace systems of FIG. 6A, without departing from this invention.

Figure 10D:
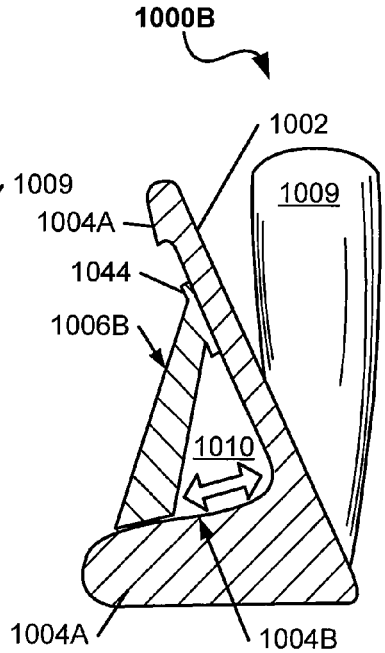

As another example, FIG. 10D shows a club head structure 1000B similar to that of FIGS. 10A and 10B, except in the structure 1000B of FIG. 10D, the bottom end of the brace system 1006B is not fixed to the interior surface 1004B of the sole oriented portion of the perimeter weighting member 1004A. Instead, the bottom end of the brace system 1006B is located in contact with or in close proximity to the interior surface 1004B of the sole oriented portion of the perimeter weighting member 1004A. In this manner, as described above in conjunction with FIG. 6B, the bottom end of the brace system 1006B may move or slide somewhat with respect to the interior surface 1004B of the sole oriented portion of the perimeter weight member 1004A when the face 1002 flexes (e.g., at least a predetermined amount) in response to contact with a golf ball. This example club head structure 1000B and brace system 1006B may have any of the desired constructions, properties, or characteristics described above, e.g., for the club heads and brace systems of FIG. 6B, without departing from this invention.

If desired, the brace systems 1006, 1006A, and 1006B (or at least portions thereof) may be covered, e.g., with a plastic or carbon fiber type cover member that fits into and/or attaches to the cavity, face, and/or the perimeter weight member 1004A. Any desired type of cover member or connection between the cover member (if any) and the club head may be used without departing from this invention.

Figure 11:
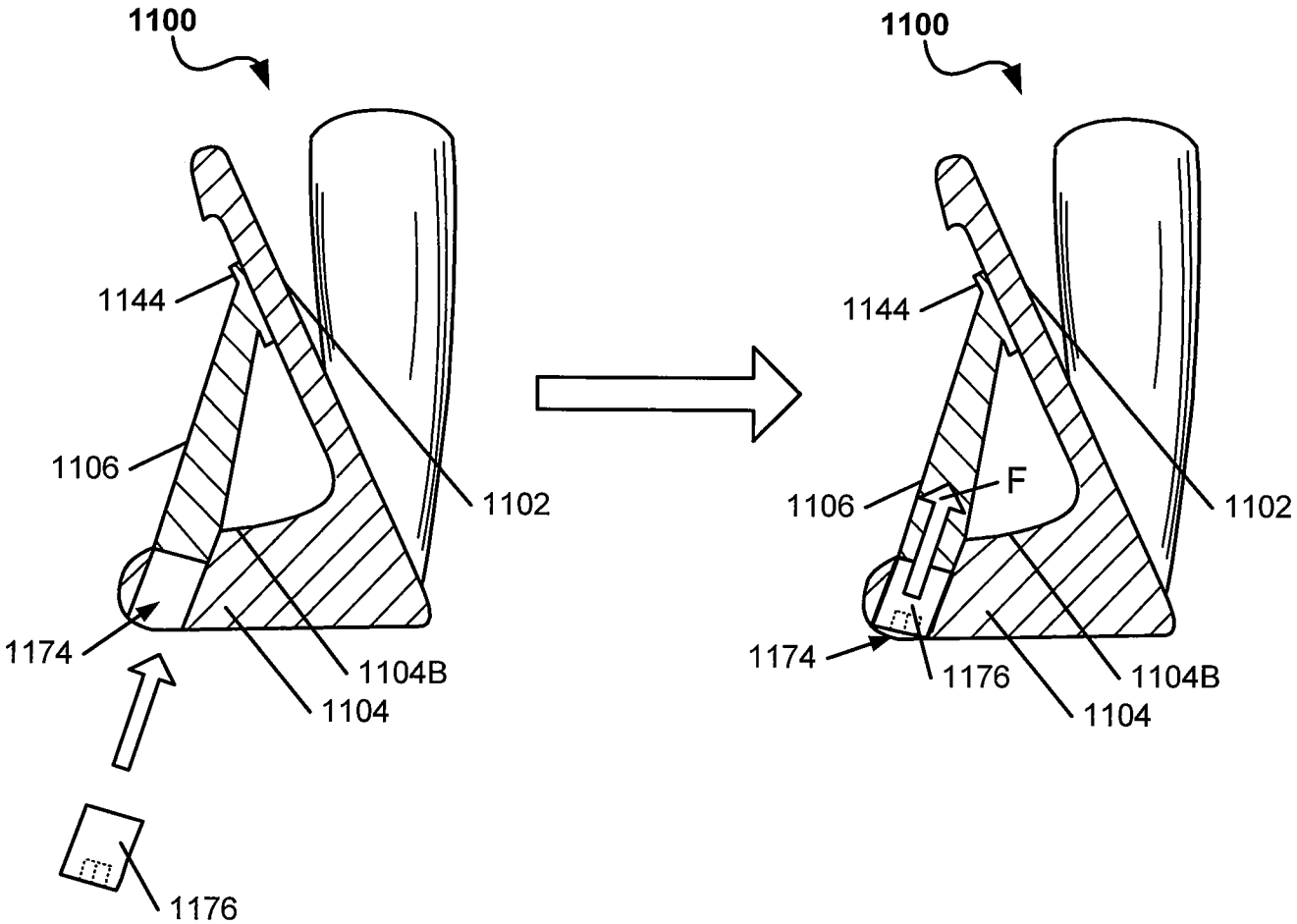
FIG. 11 illustrates potential features of an additional example iron-type ball striking device in accordance with this invention.

FIG. 11 illustrates another example iron-type golf club head 1100 in accordance with at least some example aspects of this invention. As shown in this figure, the golf club head 1100 includes an opening 1174 defined through the perimeter weight member 1104 (in this illustrated example, in the sole oriented portion of the perimeter weight member 1104). A brace member 1106 extends in a direction from the interior surface 1104B of the perimeter weight member 1104 to a contact area 1144 located on the rear surface of the ball striking face 1102 of the club head 1100. As shown in FIG. 11, the bottom end of the brace member 1106 may extend into the opening 1174. The contact area 1144 may be integrally formed with the brace member 1106, integrally formed with the rear surface of the face member 1102, or separate from these components. Optionally, the brace member 1106, the contact area 1144, and the rear surface of the face 1102 may be integrally formed or fixedly engaged with one another, e.g., by welding or other fusing techniques, by cements or adhesives, by mechanical connectors, etc.

As noted above, the bottom end of the brace member 1106 may extend into the opening 1174 in the perimeter weight member 1104. In the configuration shown at the left side of FIG. 11, the brace 1106 may not apply a force against the rear side of the face member 1102, thus the stiffening effect of this configuration may be relatively minor or minimal (e.g., simply due to the presence of the contact area 1104 and/or the resistance to face flexure due to the brace 1106 extending into the opening 1174). Additional resistance to face flexure may be provided by engaging cap member 1176 with the free end of the brace member 1106 within the interior of the opening 1174 in the perimeter weight member 1104, as shown in the right hand side of FIG. 11. The amount of face flexure (or resistance to face flexure) can be controlled based on the force F applied to the brace member 1106 via the cap member 1176.

The cap member 1176 may be engaged with the club head body and/or the brace member 1106 in any desired manner without departing from this invention, including, for example, via a threaded engagement, via a cam mechanism, via other mechanical connectors, etc. The cap member 1176 may be structured to be repeatedly removable, movable, or adjustable once in the club head structure, or it could be structured or modified so as to be permanently fixed once set to the desired force level. This iron-type golf club head structure 1100 also may have any of the desired constructions and/or characteristics described above for the various club head structures, including, for example, the features, structures, and characteristics of the club head structure 700 shown in FIG. 7.

Figure 12:
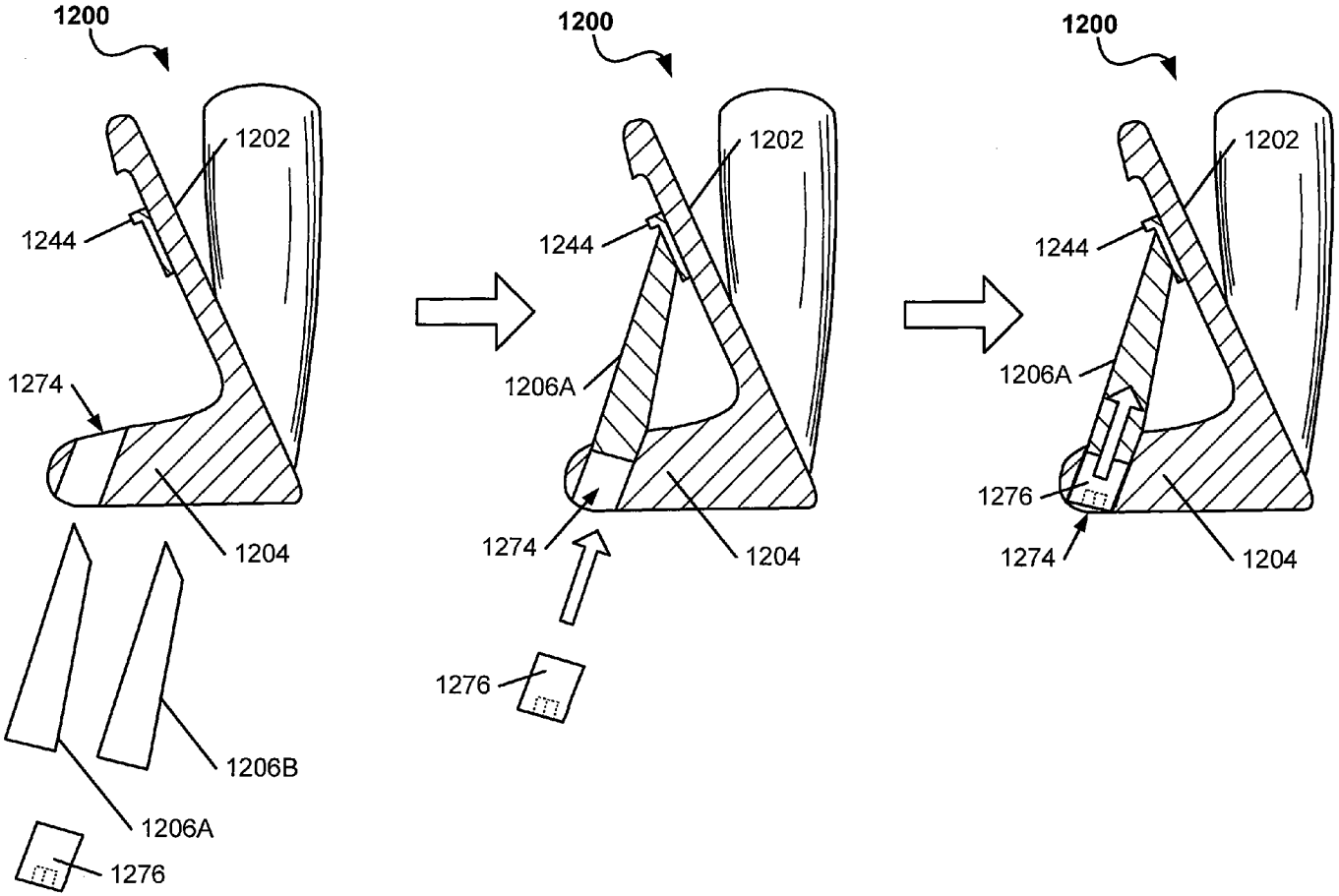
FIG. 12 illustrates examples of customization and adjustability features of ball striking devices according to at least some examples of this invention.

FIG. 12 illustrates features of another example iron-type golf club head structure 1200 in accordance with at least some example aspects of this invention. This example club head structure 1200 is similar to that shown in FIG. 11, but in this structure, at least a portion of the brace member is removable and replaceable. More specifically, as shown on the far left side of FIG. 12, the club head 1200 includes a perimeter weight member 1204 having an opening 1274 defined therein. The rear surface of the ball striking face 1202 has a contact area 1244 engaged or integrally formed therewith. Depending on the desired degree of stiffness to be locally applied to the rear surface of the face 1102, one of a variety of potential brace members (1206A and 1206B shown in FIG. 12) may be selected for insertion into the club head body (e.g., into the sole oriented portion of the perimeter weight member 1204, in this illustrated example). The various brace members 1206A and 1206B may differ, for example, in size, material, stiffness, flexibility, compressibility, etc., so that a different force will be applied to the rear surface of the face 1202 and so that a different face flexure response may be realized, depending on the brace member 1206A or 1206B selected.

Like the structure 1100 shown in FIG. 11, the opening 1274 in the perimeter weighting member 1204 may be closed off by a cap member 1276, as shown. Moreover, the force F applied to the free end of the brace 1206A by the cap member 1276 may be controlled to allow further adjustment and fine tuning of the flex characteristics of the face 1202 (e.g., as described above in conjunction with FIG. 11). This iron-type golf club head structure 1200 also may have any of the desired constructions and/or characteristics described above for the various club head structures, including, for example, the features, structures, and characteristics of the club head structure 800 shown in FIGS. 8A through 8D and the features, structures, and characteristics of the club head structure 100 shown in FIG. 11.

It is understood that the faces of the various club head structures described herein may have additional features affecting the flexibility of the face or areas thereof. For example, the faces may have areas of relatively increased or decreased thickness. Additionally, the heads described herein may contain more than one brace, optionally, creating multiple areas of relative stiffness and flexibility.

The heads disclosed herein may be used as a ball striking device or a part thereof. For example, a wood-type golf club 100 as shown in FIG. 1 or an iron-type golf club may be manufactured by attaching a shaft or handle 104 to the head, as described above. Such shaft attachments may be accomplished in conventional manners that are known and used in the art, including with releasable golf club head and shaft connection assemblies. In other embodiments, different types of ball striking devices can be manufactured according to the principles described herein.

While all of the rod or extending portions of the brace systems described herein are generally static structures, if desired, the rod portion of the brace could be formed of parts that move with respect to one another, like a spring, a shock absorber, or other dynamic structures, without departing from this invention. As another example, the rod or extending portions of the brace systems may be made from a material or provided within a housing or restraining system such that the rod or extending portions are compressible or telescoping in their axial directions. Many variations in the brace structure are possible without departing from this invention.

The ball striking devices and heads therefor as described herein provide many benefits and advantages over existing products. For example, the brace can be strategically located and designed to provide local stiffness and local flexibility in the face of the head so that certain areas of the face will have a COR response that is higher than other areas, without exceeding COR limits set by regulatory authorities. Golfers and club fitters can take advantage of aspects of this invention by having a user make multiple swings with a golf club and determining the area on the club head face where the golfer tends to make contact with the ball (e.g., using pressure sensitive contact tape). If an area of predominant contact is identified (e.g., the golfer tends to hit the ball in the toe area of the club), a head can be constructed so that the area of the face that most frequently impacts the ball during play will have a higher COR response. This can be accomplished by locating a contact area and providing a brace at the rear surface of the club head at a location away from the predominant contact area (at the heel area, in this example). A ball impacting these specific locations on the face (areas located away from the contact area and the brace) will have more energy and velocity transferred to it, thus resulting in longer hits.

An additional advantage of this invention relates to the ability to use a thinner face because the brace member acts as a reinforcement and/or backstop against excessive face flexure. In some example structures, an iron-type golf club head will have a significantly thinner face (e.g., particularly in the top half of the face). This feature reduces the weight of the face, lowers the center of gravity, and allows the club manufacturer to selectively place additional weight at other areas of the club, e.g., to further help lower the club head's center of gravity and/or to increase the moment of inertia (e.g., resistance to twisting in various directions, such as Ixx, Iyy, Izz, etc.) of the golf club head. Connecting the brace at the sole area of the club helps keep the club head's center of gravity low. The thinner face feature also helps increase the COR of the perimeter areas of the club head face and the areas away from the center, to thereby provide improved distance on off center hits.

Additionally, the use of thinner faces can help improve the flexibility of the club head face at lower swing speeds, thereby improving the COR response of the club head for golfers that tend to have slower swing speeds (and thereby improving the launch velocity and launch distance for golfers with lower swing speeds). When used as an overall reinforcement for the face as opposed to selectively controlling the COR at specific locations on the face, the enlarged end area of the brace adjacent to the face (which may act as a backstop for the face) may have an area that extends around at least the central 50% of the face interior surface area, and in some examples, it may extend around at least the central 60% or even at least the central 70% of this interior surface area. The enlarged areas, as well as other portions of the braces, may include openings through their structures or "truss like" structures, so as to reduce the overall weight of the brace. Other features and advantages also may be realized when utilizing structures in accordance with examples of this invention.

D. CONCLUSION

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head, comprising:

a face configured for striking a ball with an outer surface thereof;

a body connected to the face, the body having a sole extending rearward from a bottom edge of the face; and a brace extending from the sole to a contact point on an inner surface of the face, wherein the brace applies force to the face such that a stiffened area of the face surrounding the contact point has less flexibility relative to other areas of the face located away from the contact point, wherein the brace includes an end portion engaging the contact point, the end portion having an outermost peripheral boundary defining an elongated shape that is elongated along an axis of elongation and an entirety of the contact point between the end portion and the face is thereby elongated along the axis of elongation, such that the elongated shape and the contact point have a length along the axis of elongation that is greater than a width along a transverse axis that is perpendicular to the axis of elongation and extends along the inner surface of the face, the axis of elongation extending in a diagonal direction across the face, and wherein the stiffened area of the face is elongated along the axis of elongation, and wherein the face has one or more flexible areas located along the transverse axis on at least one side of the contact point that have greater flexibility relative to other areas of the face.

2. The wood-type golf club head of claim 1, wherein the body and the face define a cavity, and wherein the brace extends through a portion of the cavity between the sole and the face.

3. The wood-type golf club head of claim 1, wherein the brace comprises a fixed rod extending from the sole to the face.

4. The wood-type golf club head of claim 1, wherein the brace comprises an adjustable member operable to allow adjustment of the force applied to the face by the brace.

5. The wood-type golf club head of claim 4, wherein the adjustable member comprises a threaded member positioned within a threaded passage, wherein rotation of the threaded member is operable to adjust the force applied by the brace.

6. The wood-type golf club head of claim 5, wherein the brace further comprises a threaded tube extending from the sole toward the face, the threaded tube defining the threaded passage therethrough.

7. The wood-type golf club head of claim 5, wherein the threaded member has an engagement portion that is accessible from an exterior of the club head body for rotating the threaded member.

8. The wood-type golf club head of claim 1, wherein the brace includes a support member that is removable from the club head body through a first opening defined in the club head body.

9. The wood-type golf club head of claim 1, wherein the end portion is formed by a base attached to the inner surface of the face, the base having a receiver to engage an end of the brace.

10. The wood-type golf club head of claim 1, wherein the brace further comprises a rod with the end portion at an end thereof, wherein the end portion is enlarged with respect to the rod.

11. The wood-type golf club head of claim 1, wherein at least a portion of the brace is made from a material that flexes when the face flexes in response to contact with a golf ball.

12. The wood-type golf club head of claim 1, wherein the brace extends into an opening defined completely through the face.

13. The wood-type golf club head of claim 1, wherein the brace extends into an opening defined completely through the sole.

14. The wood-type golf club head of claim 1, wherein the brace is engaged with at least one of the face or the sole by a welded joint.

15. The wood-type golf club head of claim 1, wherein the inner surface of the face includes a brace contacting element having an elongated shape, and wherein the brace includes a rod having an end portion that engages the brace contacting element.

16. The wood-type golf club head of claim 15, wherein the brace contacting element includes an opening defined therein for receiving the end portion of the rod.

17. The wood-type golf club head of claim 1, wherein the contact point and the axis of elongation extends in a direction from a high heel to a low toe of the face, such that the stiffened area of the face is elongated in the direction from the high heel to the low toe and the flexible areas are located in a high toe and the low heel of the face, or the contact point and the axis of elongation extend in a direction from the high toe to the low heel of the face, such that the stiffened area of the face is elongated in the direction from the high toe to the low heel and the flexible areas are located in a high heel and the low toe of the face.

18. The wood-type golf club head of claim 1, wherein the brace engages a receptacle defined on or in the inner surface of the face.

19. The wood-type golf club head of claim 1, wherein the brace engages a receptacle defined on or in the inner surface of the sole.

20. The wood-type golf club head of claim 1, wherein the wood-type golf club head is a driver head.

21. A wood-type golf club comprising the wood-type golf club head of claim 1, and a shaft engaged with the wood-type golf club head.

22. The wood-type golf club of claim 21, wherein the wood-type golf club is a driver.

23. A wood-type golf club head, comprising:

a face configured for striking a ball with an outer surface thereof;

a body connected to the face, the body having a sole extending rearward from a bottom edge of the face; and a brace extending in a direction from an inner surface of the sole toward an inner surface of the face, the brace comprising a tube having an opening extending from an exterior surface of the sole to the inner surface of the sole, a contacting element connected to the inner surface of the face, a removable rod configured to be engaged and held by the tube such that a portion of the rod is received in the opening, and a cap configured to be connected to the tube at the exterior surface of the sole, such that the cap closes the opening and engages the rod to hold the rod in place, wherein the rod is fixedly engaged with respect to the sole by the tube and the cap, and wherein when the face flexes in response to contact with a golf ball by more than a threshold amount, the rod engages the contacting element and applies force to the face such that a stiffened area of the face surrounding a contact point between the contacting element and the face has less flexibility relative to other areas of the face located away from the contact point, wherein the rod is configured for removal by passing through the tube to an exterior of the body, wherein the contacting element has an outermost peripheral boundary defining an elongated shape that is elongated along an axis of elongation, such that the elongated shape has a length along the axis of elongation that is greater than a width along a transverse axis that is perpendicular to the axis of elongation and extends along the inner surface of the face, the axis of elongation extending in a diagonal direction across the face, and wherein the stiffened area of the face is elongated along the axis of elongation, and wherein the face has one or more flexible areas located along the transverse axis on at least one side of the contacting element that have greater flexibility relative to other areas of the face.

24. The wood-type golf club head of claim 23, wherein the contacting element includes an opening defined therein for receiving an end portion of the rod.

25. The wood-type golf club head of claim 23, wherein at least a portion of the brace is made from a material that flexes when the face flexes in response to contact with a golf ball more than the threshold amount.

26. The wood-type golf club head of claim 23, wherein at least a portion of the brace is located in contact with or adjacent an inner surface of the face, and wherein said portion is made, at least in part, from a material that compresses when the face flexes more than the threshold amount.

27. The wood-type golf club head of claim 23, wherein the brace engages a receptacle defined on or in an inner surface of the face.

28. The wood-type golf club head of claim 23, wherein the rod is removable and replaceable by removing the cap from the tube, removing the rod through the opening from the exterior surface of the sole, inserting a second rod through the opening from the exterior surface of the sole, and replacing the cap.

29. The wood-type golf club head of claim 23, wherein the tube is connected to a central inner portion of the inner surface of the sole, the central inner portion defined by an area located rearward from the face on the inner surface of the sole within a range of 25-75% of an overall depth of the golf club head in a front-to-rear direction.

30. The wood-type golf club head of claim 1, wherein the brace is connected to a central inner portion of an inner surface of the sole, the central inner portion defined by an area located rearward from the face on the inner surface of the sole within a range of 25-75% of an overall depth of the golf club head in a front-to-rear direction.

* * * * *